US009352928B2

(12) United States Patent
Wu

(10) Patent No.: US 9,352,928 B2
(45) Date of Patent: May 31, 2016

(54) THIN FILM DISPENSER

(75) Inventor: Chien-Lung Wu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 1202 days.

(21) Appl. No.: 13/274,441

(22) Filed: Oct. 17, 2011

(65) Prior Publication Data

US 2012/0099917 A1 Apr. 26, 2012

(30) Foreign Application Priority Data

Oct. 21, 2010 (TW) ..... 99135942 A

(51) Int. Cl.
*B65H 37/00* (2006.01)

(52) U.S. Cl.
CPC ..... *B65H 37/007* (2013.01)

(58) Field of Classification Search
CPC ..... B43K 21/06; B43K 24/12; B43K 37/20; B43K 29/05; B43K 24/04; B43L 19/0018; B43L 19/0068; B43L 19/0081; B65H 37/00; B65H 37/007
USPC ..... 401/29–32, 52, 55, 65, 68, 99; 15/105.51, 424, 426, 429–431, 433
See application file for complete search history.

(56) References Cited

U.S. PATENT DOCUMENTS

| | | | | |
|---|---|---|---|---|
| 5,642,953 | A * | 7/1997 | Kobayashi et al. | 401/30 |
| 5,890,825 | A * | 4/1999 | Kageyama et al. | 401/52 |
| 5,927,882 | A * | 7/1999 | Kageyama | 401/52 |
| 5,988,913 | A | 11/1999 | Kageyama et al. | |
| 6,290,413 | B1 * | 9/2001 | Wang | 401/30 |
| 6,517,271 | B1 | 2/2003 | Kageyama et al. | |
| 6,517,272 | B1 | 2/2003 | Kageyama et al. | |
| 7,571,754 | B2 | 8/2009 | Ushijima | |
| 2007/0113987 | A1 * | 5/2007 | Ushijima | 156/577 |
| 2010/0288193 | A1 * | 11/2010 | Wu | 118/76 |

FOREIGN PATENT DOCUMENTS

| | | | |
|---|---|---|---|
| CN | 201224278 | Y | 4/2009 |
| JP | H1086595 | A | 4/1998 |
| TW | 200720109 | | 6/2007 |
| TW | 200738489 | | 10/2007 |
| TW | M323396 | U | 12/2007 |
| TW | M323995 | U | 12/2007 |

* cited by examiner

*Primary Examiner* — Mark A Laurenzi
*Assistant Examiner* — Bradley Oliver
(74) *Attorney, Agent, or Firm* — Alan D. Kamrath; Kamrath IP Lawfirm, P.A.

(57) ABSTRACT

A thin film dispenser has a body, a moving assembly, a resilient positioning element, a dispensing unit and a push button. The body has an opening, a sliding channel and two sets of positioning recesses. The moving assembly is connected to the dispensing unit. The resilient positioning element is connected to the moving assembly and has a positioning segment selectively engaging one of the two sets of positioning recesses. The dispensing unit has a dispensing head corresponding to the opening of the body. The push button is mounted slidably in the sliding channel of the body, is connected to the moving assembly and selectively pushes against the positioning segment of the resilient positioning element to disengage from a corresponding set of positioning recesses to enable the moving assembly to move relative to the body.

36 Claims, 31 Drawing Sheets

THIN FILM DISPENSER

BACKGROUND OF THE INVENTION

1. Field of the Invention

The present invention relates to a stationery tool and, more particularly, to a thin film dispenser having a push button to control a dispensing head to extend out of or be retracted into a body of the dispenser.

2. Description of Related Art

A conventional correction tape dispenser can control a dispensing head of a dispensing unit extending out of or being retracted into a body in a manner of pushing to dispense a correction tape onto a sheet of paper or the like to correct errors on the paper. Taiwan Patent Publication No. 200720109, entitled "Coating Film Transferring Tool", discloses a pushing structure for controlling the dispensing unit. With reference to FIGS. 29 and 30, the '109 patent discloses a body 50, a dispensing unit 51 and a push button 54. The body 50 has an elongated slot 53 defined in one side of the body 50. The slot 53 has two pairs of positioning recesses 530,531 defined respectively in two side walls of the slot 53 and are respectively adjacent to a rear end and a middle of the slot 53. The dispensing unit 51 is mounted in the body 50. The push button 54 is connected to the dispensing unit 51 and is slidably mounted in the slot 53. The push button 54 has a V or Y shaped resilient positioning element 540 mounted on the push button 54 and mounted slidably in the slot 53. Two ends of the resilient positioning element 540 selectively engage one of the pairs of positioning recesses 530,531 to hold a dispensing head of the dispensing unit 51 at an expended or retracted position relative to the body 50.

When the push button 54 slides along the slot 53, the ends of the V or Y shaped resilient positioning element 540 will be compressed by the side walls of and slide along the slot 53. However, the forces applied to the ends of the resilient positioning element 540 while the push button 54 is pushed to move forward and backward are different and in different directions, and the movement of the push button 54 is uneven and not smooth. In addition, the push button 54 is held in position with the engagement between the ends of the resilient positioning element 540 and the corresponding positioning recesses 530,531, and the positioning effect provided by the resilient positioning element 540 is not sufficient to securely hold the push button 54. When the dispensing head of the dispensing unit 51 is pushed onto a paper for dispensing the correction tape, a force is applied onto the dispensing head and causes the ends of the resilient positioning element 540 to disengage from the corresponding positioning recesses 531. Consequently, the dispensing unit will retract into the body 50 unintentionally, and this causes inconvenient use.

In addition, to improve the utility of a conventional correction tape dispenser, a rubber is mounted on the conventional correction tape. Taiwan Utility Model No. M323995, entitled "Dual Purpose Correction Tape", discloses a rubber pressed into a body of a correction tape dispenser. With reference to FIG. 31, the correction tape dispenser of the '995 patent comprises a body 60 having a holding recess 61 defined in a rear end of the body 60. A rubber 62 is pressed into and securely held in the holding recess 61, and a cap 63 is detachably mounted on the rear end of the body 60 to hold the rubber 62 inside to prevent the rubber 62 from being dirtied. In use, the body 60 is upside down to enable the rubber 62 to correct errors on the paper made by a pencil. With such an arrangement of the rubber 62, the alternative use of the correction tape and the rubber 62 is convenient, and the rubber 62 can be kept from disappearing.

However, since the rubber 62 is mounted securely on the body 60, and as long as deformation of the rubber 62 occurs, the rubber 62 is easily detached from the body 60 when wiping pencil marks out. In addition, the extension length of the rubber 62 cannot be adjusted relative to the body 60, and the rubber 62 cannot be retracted into or extended out of the body 60. This is not versatile in use. Furthermore, when the rubber 62 is used up or damaged, the used rubber 62 cannot easily be removed from the body 60 and replaced with a new one.

To overcome the shortcomings, the present invention provides a thin film dispenser to mitigate or obviate the aforementioned problems.

SUMMARY OF THE INVENTION

The main objective of the invention is to provide a thin film dispenser having a push button that can be pushed to be smoothly moved and to be securely positioned to conveniently control a dispensing head to extend out of or be retracted into a body of the thin film dispenser. The thin film dispenser could further have a rubber holding device securely clamping a rubber and having capabilities of adjusting an extension length of the rubber and conveniently replacing a used rubber.

The thin film dispenser in accordance with the present invention has a body, a moving assembly, a resilient positioning element, a dispensing unit and a push button. The body has an opening, a sliding channel and multiple sets of positioning recesses. The opening is defined in one end of the body. The sliding channel is defined in one side of the body, extends along a direction and has two side walls. The sets of positioning recesses are defined respectively and separately in the side walls of the sliding channel. The moving assembly is mounted in the body. The resilient positioning element is connected to the moving assembly and has a positioning segment. The positioning segment extends along a direction perpendicular to that of the sliding channel and selectively engages one of the sets of the positioning recesses. The dispensing unit is mounted in the body, is connected to the moving assembly and has a dispensing head corresponding to the opening of the body. The push button is mounted slidably in the sliding channel of the body, is connected to the moving assembly and selectively pushes against the positioning segment of the resilient positioning element to disengage from a corresponding set of positioning recesses to enable the moving assembly to move relative to the body.

With such an arrangement, the dispensing head of the dispensing unit can be extended out of or retracted into the body easily and conveniently. The dispensing head can be stably positioned at an expanded position and kept from retracting into the body even when a force is applied onto the dispensing head. The use of the thin film dispenser is stable and smooth. With the disassembled body, when the dispensing tape of the dispensing unit is used up, the used dispensing unit can be easily replaced with a new one after the body is disassembled.

Other objectives, advantages and novel features of the invention will become more apparent from the following detailed description when taken in conjunction with the accompanying drawings.

DETAILED DESCRIPTION OF PREFERRED EMBODIMENTS

The present invention relates to a thin film dispenser having a push button to control a dispensing head to extend out of or be retracted into a body of the thin film dispenser. The thin film dispenser in accordance with the present invention includes all devices that can apply a thin film onto a desired location and may be a correction tape dispenser or an adhesive tape dispenser. The thin film dispenser further has a rubber holding device securely clamping a rubber and having capabilities of adjusting an extension length of the rubber and conveniently replacing a used rubber to make the thin film dispenser having dual functions on a single tool.

Figure 1:
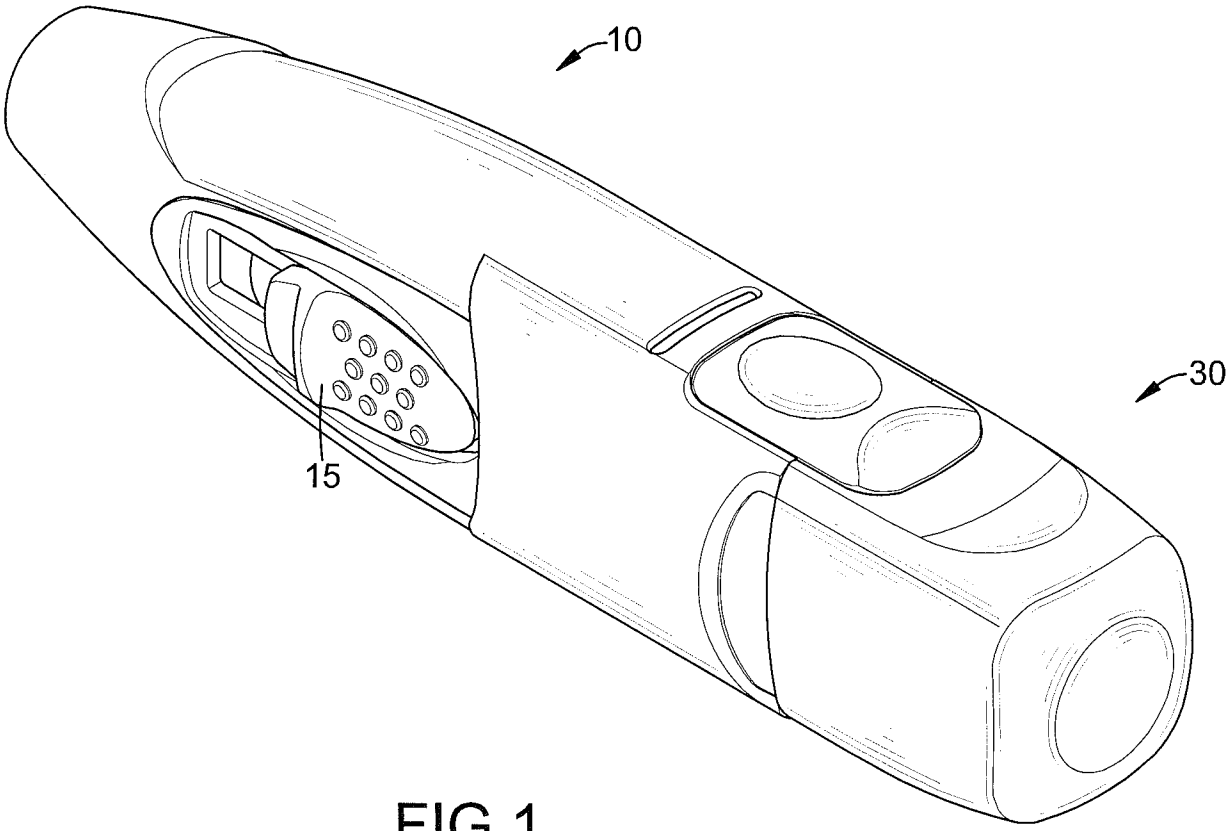
FIG. 1 is a perspective view of a first embodiment of a thin film dispenser in accordance with the present invention.
Figure 2:
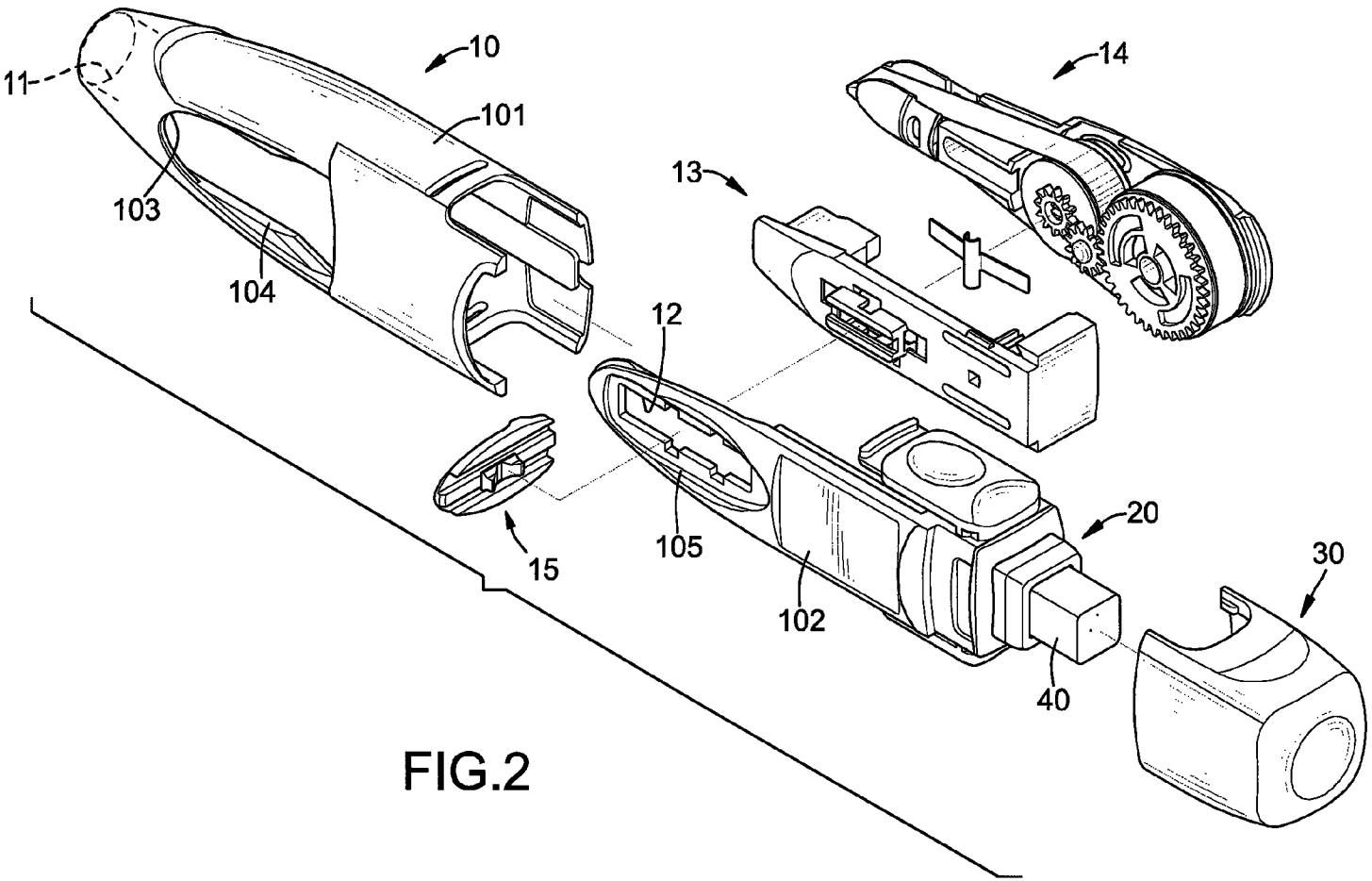
FIG. 2 is an exploded perspective view of the thin film dispenser in FIG. 1.
Figure 3:
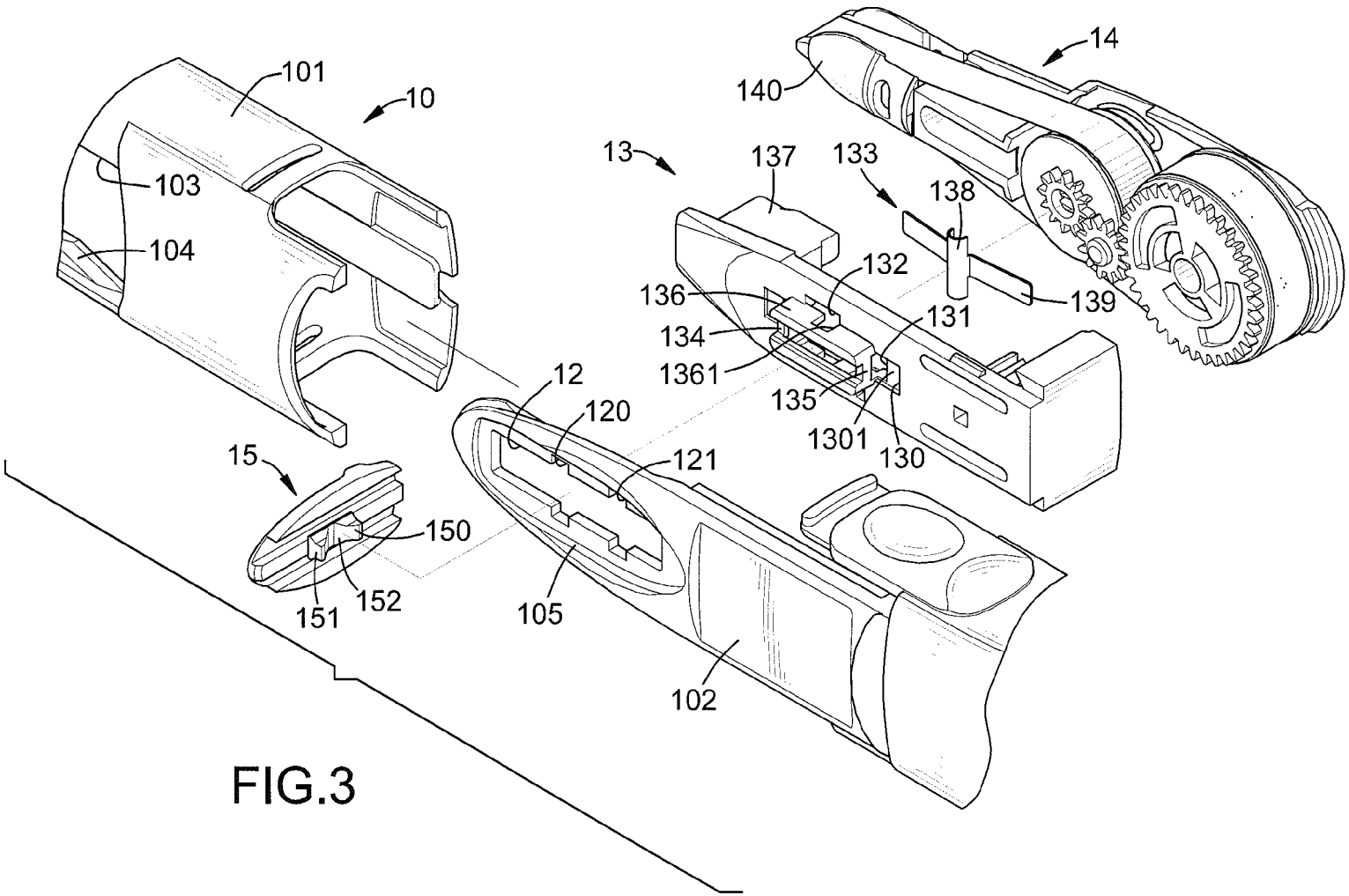
FIG. 3 is an enlarged partially exploded perspective view of the thin film dispenser in FIG. 1.

With reference to FIGS. 1 to 3, the first embodiment of a thin film dispenser in accordance with the present invention comprises a body 10, a rubber holding device 20 and a cap 30.

The body 10 may be elongated and has an opening 11, a sliding channel 12 and two sets of positioning recesses. The opening 11 is defined in one end of the body 10. The sliding channel 12 is elongated, is defined in one side of the body 10, extends along a direction and has two side walls. The sets of positioning recesses include a first set of positioning recesses 120 and a second set of positioning recesses 121 and are defined respectively and separately in the side walls of the sliding channel 12. The first set of positioning recesses 120 is defined adjacent to the opening 11, and the second set of positioning recesses 121 is defined opposite to the opening 11.

Preferably, the body 10 comprises two half housings. In the first embodiment, the body 10 comprises a front housing 101 and a rear housing 102. The front housing 101 has a first end in which the opening 11 of the body 10 is defined and a second end formed as a combining mouth. The front housing 101 further has an assembling hole 103 defined in a side of the front housing 101 and a supporting segment 104 formed adjacent to the assembling hole 103. The rear housing 102 is combined with the front housing 101 and has a first end, a side and a combining segment 105. The first end of the rear housing 102 is mounted in the combining mouth of the front housing 101. The side of the rear housing 102 corresponds to the side of the front housing 101 in which the assembling hole 103 is defined. The sliding channel 12 and the sets of the positioning recesses 120,121 are defined in the side of the rear housing 102. The combining segment 105 is supported on the supporting segment 104 of the front housing 101. Alternatively, the body 10 may comprise upper and lower housings or right and left housings. The body 10 in accordance with the present invention comprises detachable housings, and the type, number and combination of the housings are not limited in the present invention.

Figure 4:
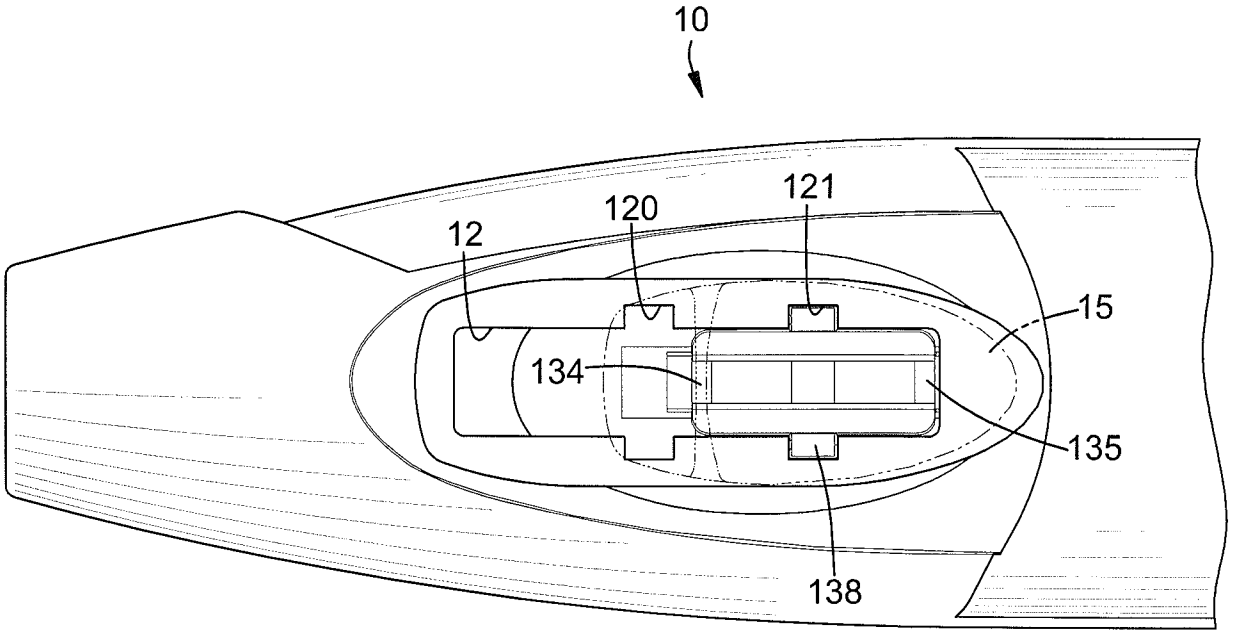
FIG. 4 is an enlarged side view of the thin film dispenser in FIG. 1 showing the positioning segment of the resilient positioning element engaging the second set of positioning recesses.
Figure 5:
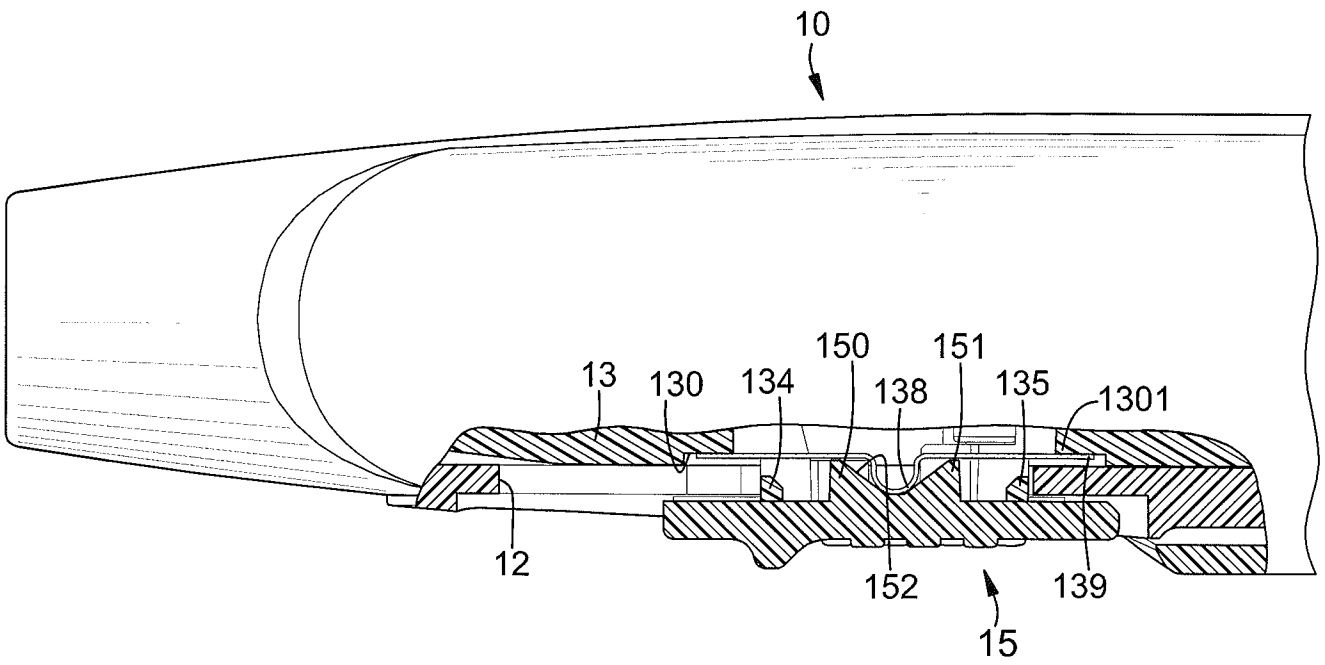
FIG. 5 is an enlarged top view in partial section of the thin film dispenser in FIG. 1 showing the positioning segment of the resilient positioning element engaging the second set of positioning recesses.

With further reference to FIGS. 4 and 5, the thin film dispenser in accordance with the present invention further has a moving assembly 13, a resilient positioning element 133, a dispensing unit 14 and a push button 15. The moving assembly 13 may be an elongated plate, is mounted in the body 10 and comprises an elongated recess 130, a longitudinal through hole 131, a lateral through hole 132, a first side board 134, a second side board 135, two guiding side panels 136 and a dispensing unit mounting post 137. The elongated recess 130 is defined in the moving assembly 13 at a side facing the sliding channel 12, extends along a longitudinal axis of the moving assembly 13 and has a bottom. The longitudinal through hole 131 is defined through the bottom of the elongated recess 130 and the moving assembly 13 and having a length shorter than that of the elongated recess 130, such that two supporting shoulders 1301 are formed respectively on two ends of the elongated recess 130. The lateral through hole 132 is defined through the moving assembly 13, is perpendicular to the longitudinal through hole 131 and communicates with the longitudinal through hole 131 and the elongated recess 130.

The resilient positioning element 133 is connected to the moving assembly 13, is mounted in the elongated recess 130 via the longitudinal through hole 131 and the lateral through hole 132 and comprises a positioning segment 138 and two wings 139. The positioning segment 138 is an elongated resilient plate being curved in cross section, extends along a direction perpendicular to that of the sliding channel 12 and selectively engages one of the sets of the positioning recesses 120,121. The wings 139 are formed respectively on two sides of the positioning segment 138 and are supported respectively on the supporting shoulders 1301 in the elongated recess 130.

The first side board 134 and the second side board 135 are formed on and protrude from the moving assembly 13 at a side facing the sliding channel 12 and are mounted in the sliding channel 12. The first side board 134 and the second side board 135 are located respectively at two sides of the positioning segment 138 of the resilient positioning element 133. The first side board 134 is adjacent to the opening 11 of the body 10, and the second side board 135 is opposite to the opening 11 of the body 10.

The guiding side panels 136 are disposed respectively on tops and bottoms of the first side board 134 and the second side board 135. Each guiding side panel 136 has a positioning notch 1361 defined in a side of the guiding side panel 136 facing the elongated recess 130 and aligning with each other to hold the positioning segment 138 of the resilient positioning element 133 inside. The dispensing unit mounting post 137 is formed on a side of the moving assembly 13 opposite to the sliding channel 12.

The dispensing unit 14 is mounted in the body 10, is connected to the moving assembly 13 and preferably is detachably connected to the dispensing unit mounting post 137 on the moving assembly 13. The dispensing unit 14 has a dispensing head 140 corresponding to the opening 11 of the body 10. To replace the dispensing unit 14, the front housing 101 and the rear housing 102 of the body 10 are detached from each other firstly. A used dispensing unit 14 is removed from the moving assembly 13, and a new one is mounted onto the dispensing unit mounting post 137 on the moving assembly 13. The rear housing 102 with the moving assembly 13 is reassembled with the front housing 101 to form a complete thin film dispenser.

The push button 15 is mounted slidably in the sliding channel 12 of the body 10 and is connected to the moving assembly 13. The push button 15 has a first pushing block 150 and a second pushing block 151 formed on an inner surface of the push button 15 and held between the first side board 134 and the second side board 135. The first pushing block 150 has an inclined surface defined in a side facing the second pushing block 151. The second pushing block 151 has an inclined surface defined in a side facing the first pushing block 150 to define a receiving recess 152 between the first and second pushing blocks 150,151 and hold the positioning segment 138 of the resilient positioning element 133 inside.

Figure 6:
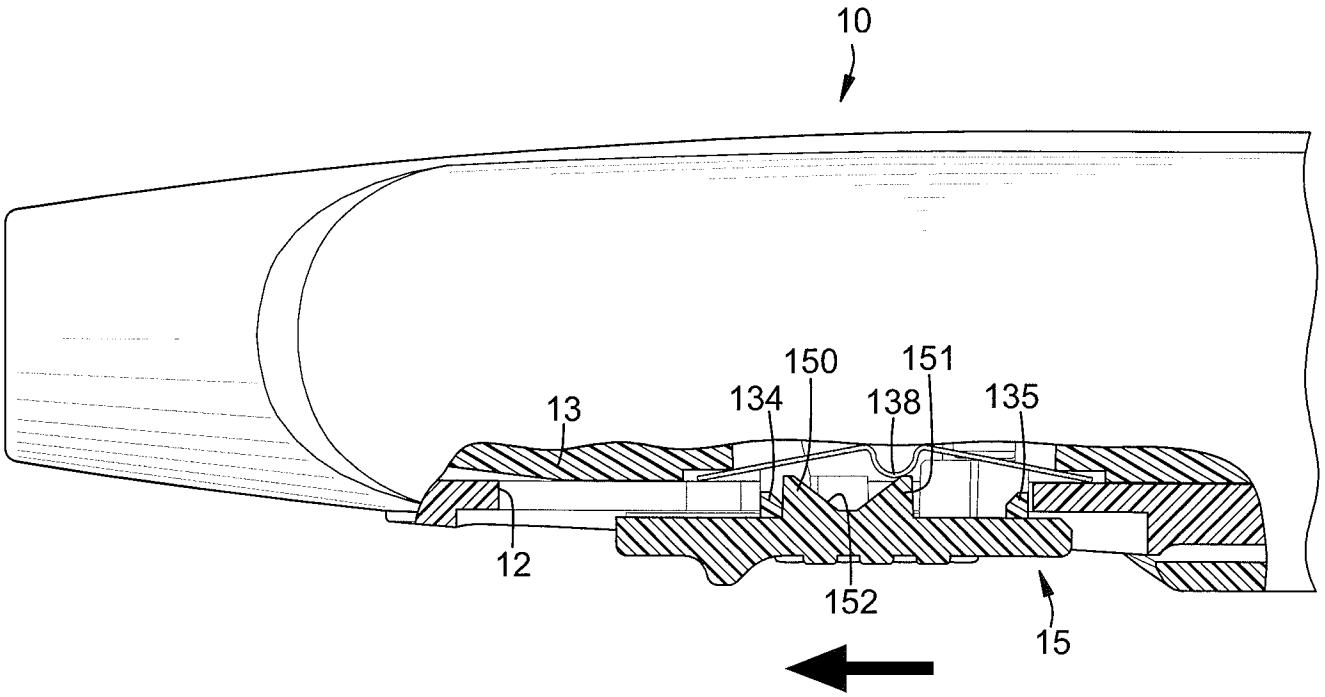
FIG. 6 is an enlarged operational top view in partial section of the thin film dispenser in FIG. 1 showing the second pushing block of the push button pushing against the positioning segment of the resilient positioning element to disengage from the second set of positioning recesses.
Figure 7:
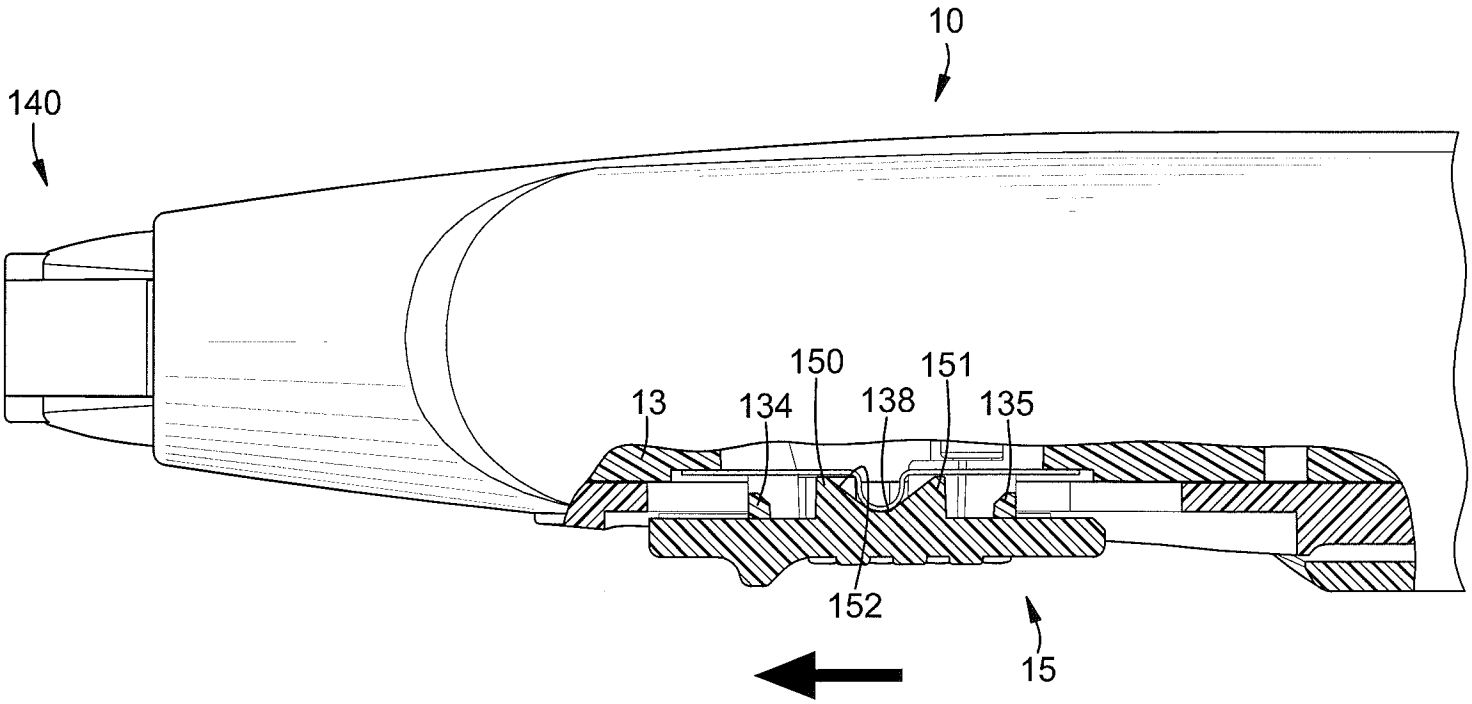
FIG. 7 is an enlarged operational top view in partial section of the thin film dispenser in FIG. 1 showing the positioning segment of the resilient positioning element engaging the first set of positioning recesses.
Figure 8:
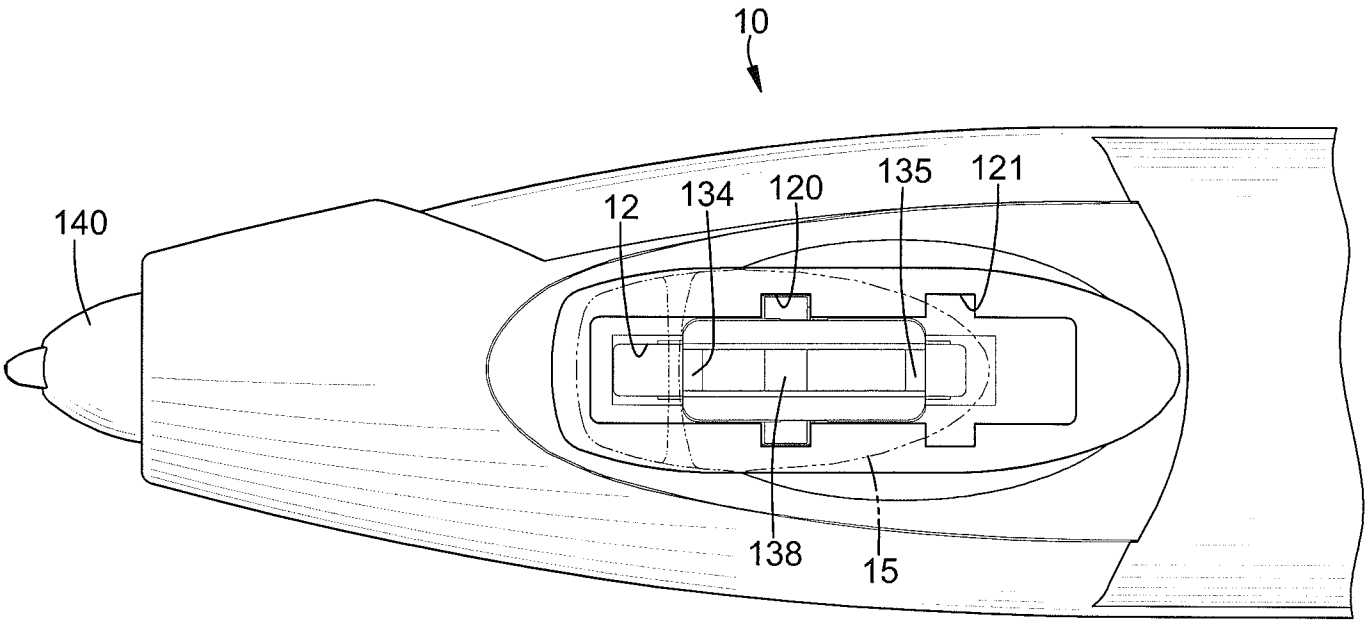
FIG. 8 is an enlarged side view of the thin film dispenser in FIG. 1 showing the positioning segment of the resilient positioning element engaging the first set of positioning recesses.

When the dispensing head 140 of the dispensing unit 14 is retracted in the body 10, the positioning segment 138 of the resilient positioning element 133 engages the second set of positioning recesses 121. With reference to FIGS. 6 to 8, when the thin film dispenser is in use, the push button 15 is pushed to move along the sliding channel 12 toward the first set of positioning recesses 120. The second pushing block 151 on the push button 15 pushes against the positioning segment 138 to disengage from the second set of positioning recesses 121. At this time, the first pushing block 150 abuts with the first side board 134, such that the moving assembly 13 and the dispensing unit 14 are moved with the push button 15 toward the opening 11. When the dispensing head 140 of the dispensing unit 14 extends out of the opening 11 of the body 10, the positioning segment 138 of the resilient positioning element 133 engages the first set of positioning recesses 120 and is mounted in the receiving recess 152 in the push button 15 with the resilience of the positioning segment 138. Accordingly, the dispensing head 140 of the dispensing unit 14 is held at the expanded position.

When the thin film dispenser is not in use, the push button 15 is pushed to move backward along the sliding channel 12 and toward the second set of positioning recesses 121. The first pushing block 150 of the push button 15 will press the positioning segment 138 to disengage from the first set of positioning recesses 120, and the second pushing block 151 abuts with the second side board 135. Consequently, the moving assembly 13 and the dispensing unit 14 are moved with the push button 15 away from the opening 11. When the dispensing head 140 of the dispensing unit 14 is retracted into the body 10, the positioning segment 138 of the resilient positioning element 133 reengages the second set of positioning recess 121 and is mounted in the receiving recess 152 in the push button 15. The dispensing head 140 is held at the retracted position.

Because the resilient positioning element 133 is securely mounted on the moving assembly 13 and engages one of the sets of positioning recesses 120,121, a stable and secure positioning effect is provided. Therefore, even when a force is applied onto the dispensing head 140 while the thin film dispenser is in use, the dispensing head 140 can be held at the expanded position and is not retracted into the body 10 unintentionally. The use of the thin film dispenser is stable.

With the aforementioned structure and operation of the thin film dispenser, the dispensing head 140 of the dispensing unit 14 can be securely held at the extended or retracted position.

The dispensing head 140 can be stably positioned and kept from retracting into the body 10 even when a force is applied onto the dispensing head 140. When the dispensing tape of the dispensing unit 14 is used up, the used dispensing unit 14 can be easily replaced with a new one after the body 10 is disassembled.

Figure 9:
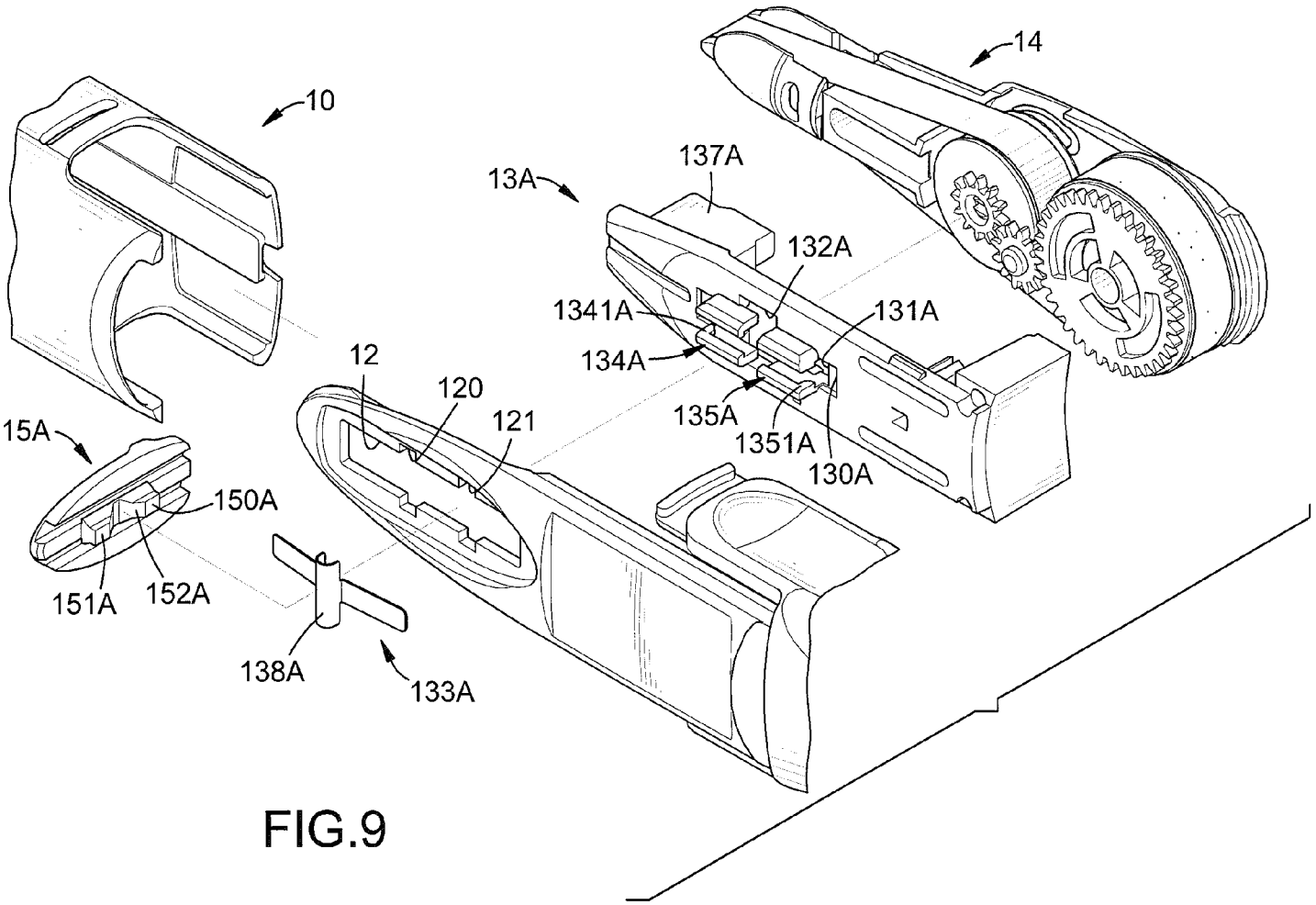
FIG. 9 is a partially exploded perspective view of a second embodiment of a thin film dispenser in accordance with the present invention.

With reference to FIG. 9, in the second embodiment of the thin film dispenser in accordance with the present invention, the moving assembly 13A is connected to a push button 15A and has an elongated recess 130A, a longitudinal through hole 131A, a lateral through hole 132A and a dispensing unit mounting post 137A the same as those in the first embodiment.

The moving assembly 13A further has a first frame 134A and a second frame 135A formed on the moving assembly 13A at a side facing the sliding channel 12, mounted in the sliding channel 12 and located respectively at two sides of the positioning segment 138A of the resilient positioning element 133A. The first frame 134A is adjacent to the opening 11, and the second frame 135A is opposite to the opening 11. The first frame 134A has two first frame panels parallel with each other and protruding from the moving assembly 13A at the side facing the sliding channel 12. The first frame 134A further has an L-shaped first abutting flange 1341A formed on the first frame 134A. The second frame 135A has two second frame panels parallel with each other and protruding from the moving assembly 13A at the side facing the sliding channel 12. The second frame 135A has an L-shaped second abutting flange 1351A formed on the second frame 135A.

With the arrangement of the parallel frame panels of the side boards 134A,135A, the resilient positioning element 133A can be directly mounted in the elongated recess 130A via the side boards 134A, 135A and through the longitudinal through hole 131A without compressing the resilient positioning element 133A. The assembling of the resilient positioning element 133A onto the moving assembly 13A is convenient, and the shape of the resilient positioning element 133A can be kept without deformation.

The push button 15A is mounted slidably in the sliding channel 12 of the body 10 and is connected to the moving assembly 13A. The push button 15A has a first pushing block 150A and a second pushing block 151A formed on an inner surface of the push button 15A and extending through the sliding channel 12. The first pushing block 150A is held slidably in the first side board 134A between the two first frame panels and selectively abuts with the first abutting flange 1341A. The second pushing block 151A is held slidably in the second side board 135A between the two second frame panels and selectively abuts with the second abutting flange 1351A. The first pushing block 150A has an inclined surface defined in a side facing the second pushing block 151A. The second pushing block 151A has an inclined surface defined in a side facing the first pushing block 150A to define a receiving recess 152A between the first and second pushing blocks 150A,151A and hold the positioning segment 138A of the resilient positioning element 133A inside.

Figure 10:
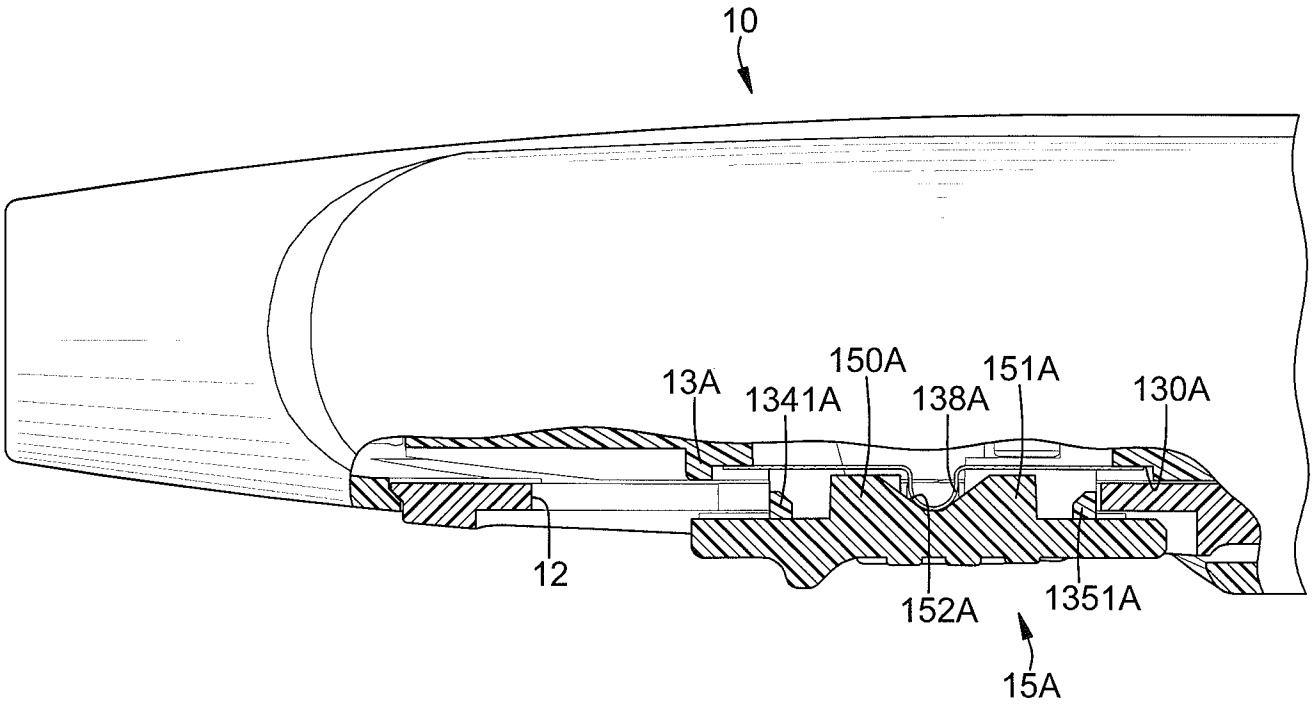
FIG. 10 is an enlarged top view in partial section of the thin film dispenser in FIG. 9 showing the positioning segment of the resilient positioning element engaging the second set of positioning recesses.
Figure 11:
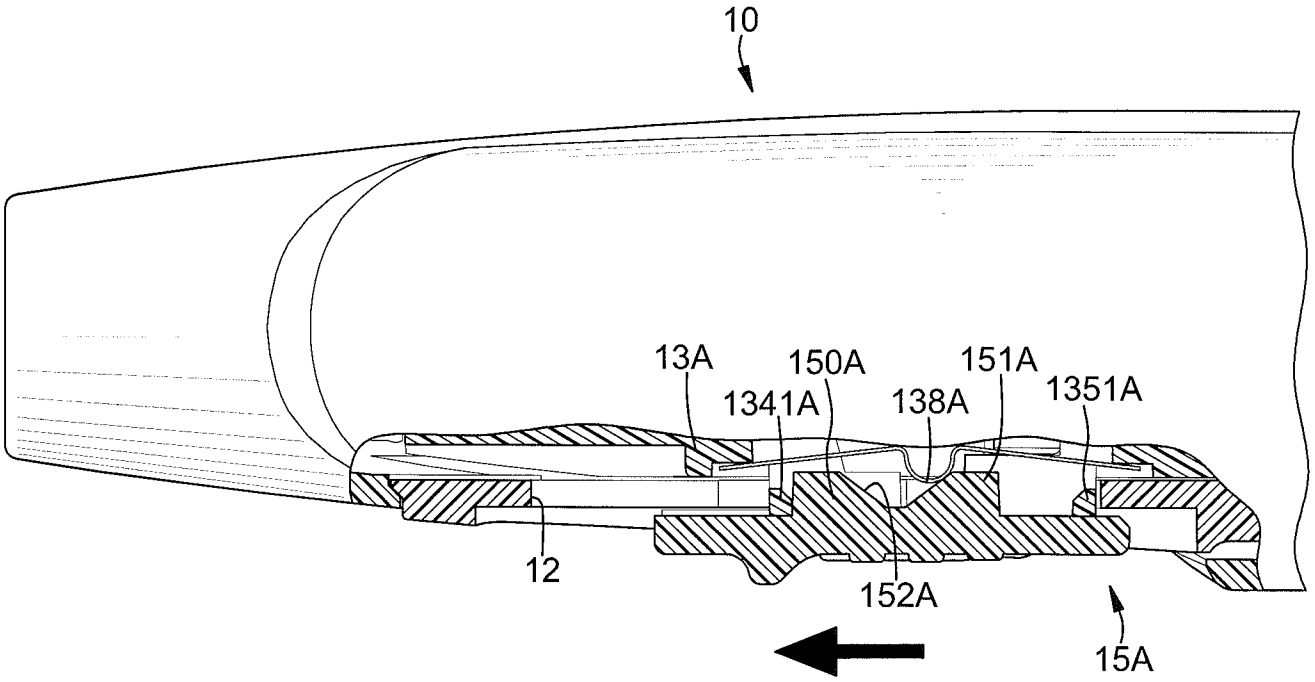
FIG. 11 is an enlarged operational top view in partial section of the thin film dispenser in FIG. 9 showing the second pushing block of the push button pushing against the positioning segment of the resilient positioning element to disengage from the second set of positioning recesses.
Figure 12:
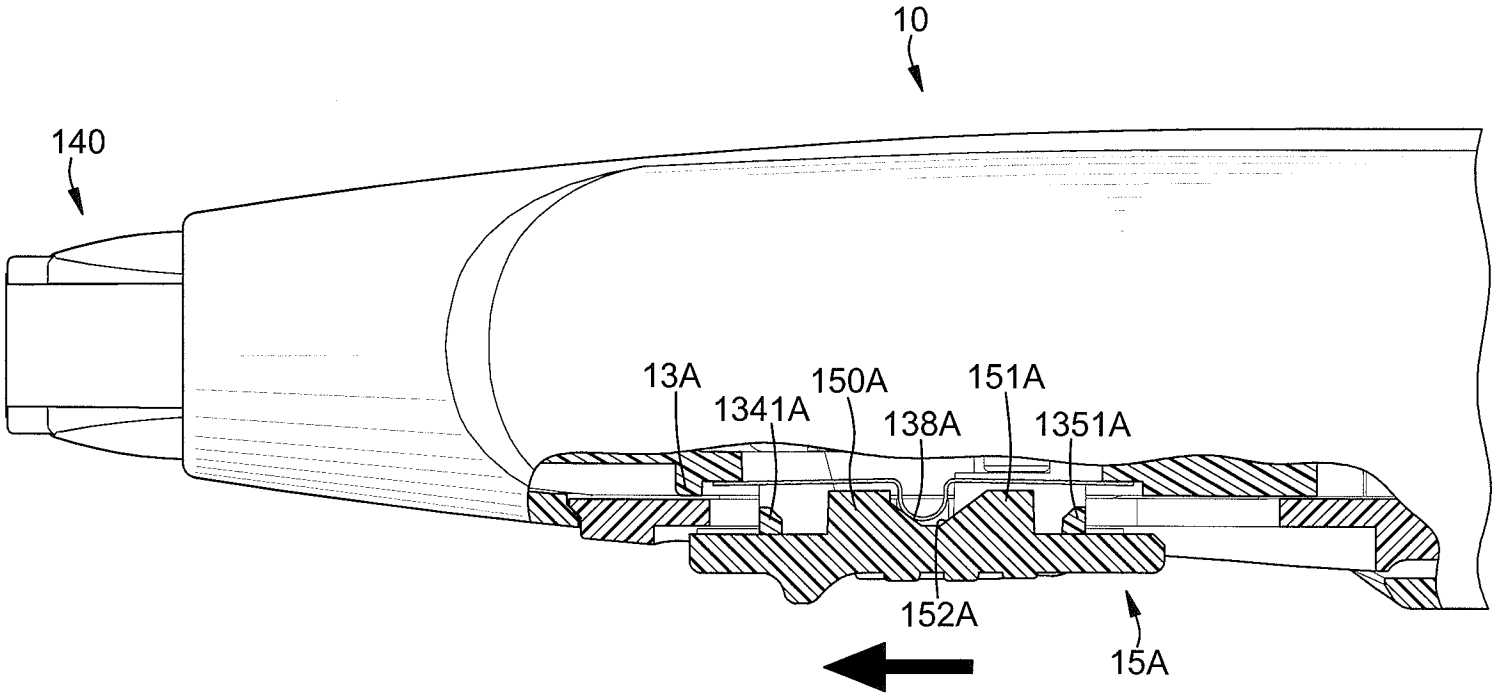
FIG. 12 is an enlarged operational top view in partial section of the thin film dispenser in FIG. 9 showing the positioning segment of the resilient positioning element engaging the first set of positioning recesses.

With reference to FIGS. 10 to 12, the operation of the second embodiment is substantially the same as that of the first embodiment except that when the push button 15A is pushed to move toward the first set positioning recess 120, the first pushing block 150A abuts with the first abutting flange 1341A on the first side board 134A to move the moving assembly 13A forward. When the push button 15A is moved toward the second set of positioning recesses 121, the second pushing block 151A abuts with the second abutting flange 1351A on the second side board 135A to move the moving assembly 13A backward.

Figure 13:
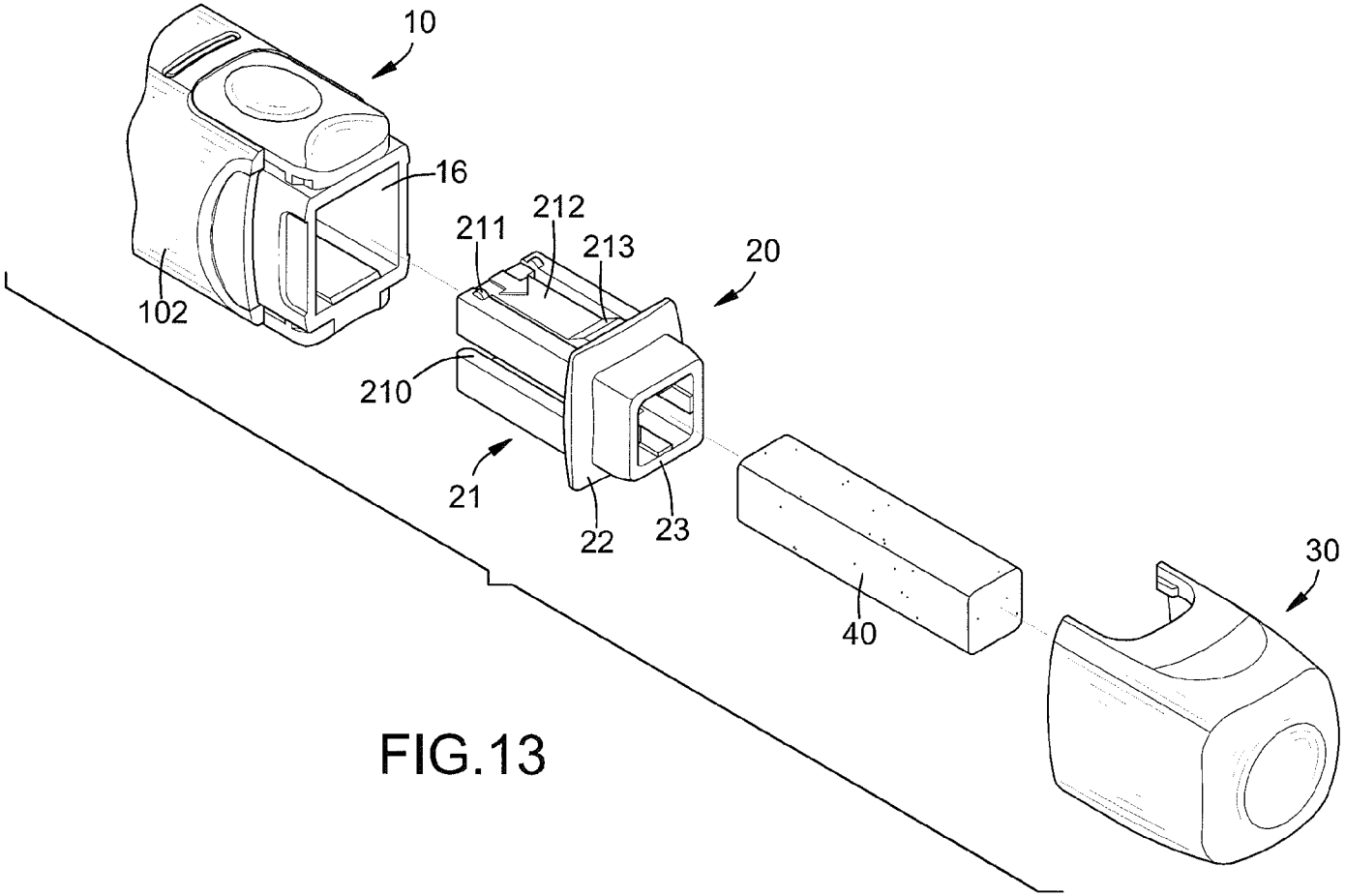
FIG. 13 is a partially exploded perspective view of a first embodiment of a rubber holding device of a thin film dispenser in accordance with the present invention.
Figure 14:
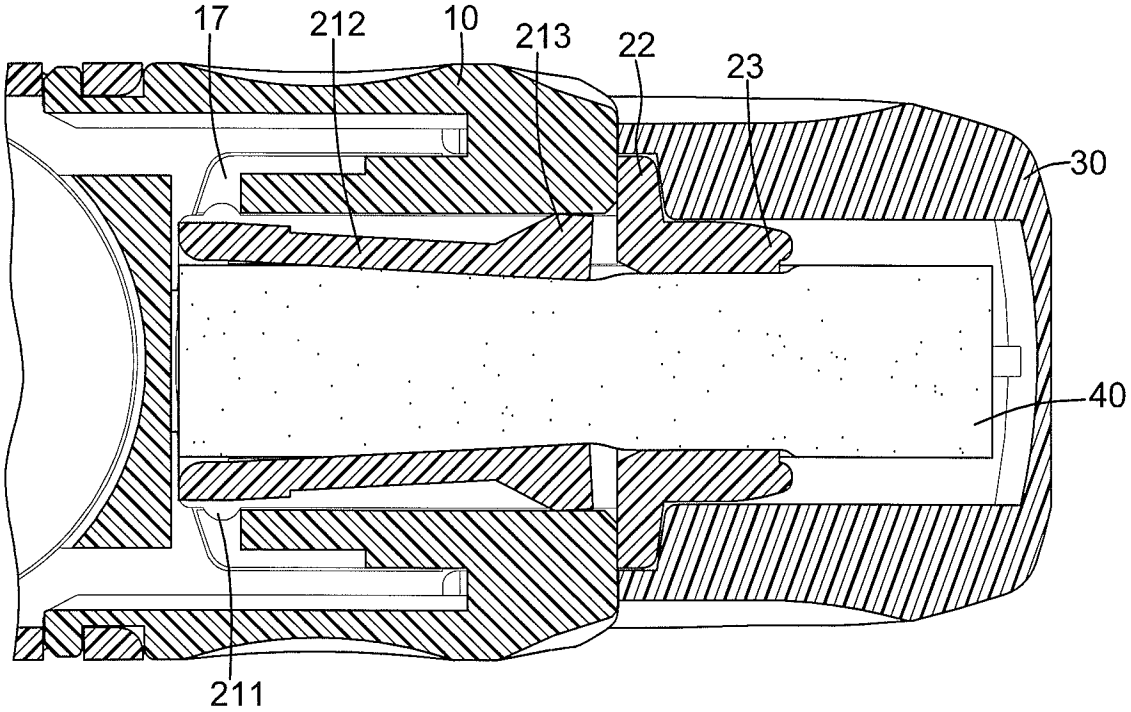
FIG. 14 is an enlarged side view in partial section of the rubber holding device in FIG. 13.

With reference to FIGS. 13 and 14, the body 10 has a holding recess 16 defined in a holding end of the body 10 opposite to the opening 11. The holding recess 16 has a mouth defined in the holding end of the body 10 and preferably defined in a second end of the rear housing 102 of the body 10. A first buckling segment 17 is formed on the inner surface of the holding recess 16. The first buckling segment 17 is formed on two opposite sides of the inner surface of the holding recess 16 at an inner end opposite to the mouth. The first buckling segment 17 may be implemented as two buckling cavities formed respectively in the opposite sides of the inner surface of the holding recess 16.

The rubber holding device 20 may be a hollow rectangular frame, is mounted detachably on the body 10 and comprises a rubber opening, a clamping segment 21, a stopping flange 22 and a guiding segment 23. The rubber opening is defined in the rubber holding device 20 at a position relative to the holding end of the body 10. Preferably, the rubber opening is defined in one end of the rubber holding device 20 that is outside or inside the holding end of the body 10. The clamping segment 21 is detachably mounted in the holding recess 16 of the body 10 and is slidable between the holding recess 16 and the rubber opening. The clamping segment 21 has an outer end adjacent to the rubber opening and an inner end opposite to the rubber opening. The clamping segment 21 has a resilient slot 210 formed laterally in middle portions of two side walls of the clamping segment 21 to divide the clamping segment 21 into two half clamping frames, such that the half clamping frames have a resilient capability to be pressed toward each other. The clamping segment 21 has a second buckling segment 211 formed on the inner end at the outer sides of the half clamping frames and engaging the first buckling segment 17 on the body 10 to keep the rubber holding device 20 from detaching from the body 10. Preferably, the second buckling segment 211 comprises two buckling bosses respectively formed on and protruding from the inner ends at the outer sides of the half clamping frames.

The clamping segment 21 further comprises two resilient arms 212 formed on the middle portions of the half clamping frames, and each resilient arm 212 has an inner end and an outer end. The inner end is connected integrally with the inner end of the corresponding half clamping frame. The outer end extends outwardly and is provided with a clamping protrusion 213. The clamping protrusion 213 abuts against the inner surface of the holding recess 16 in the body 10 to enable the resilient arm 212 to resiliently protrude into the inner space of the clamping segment 21 for securely clamping a rubber 40.

The stopping flange 22 may be rectangular in cross section, is formed around the outer end of the clamping segment 21 and abuts with the holding end of the body 10 at which the mouth of the holding recess 16 is defined.

The guiding segment 23 may be a rectangular frame, is formed at the outer end of the clamping segment 21 and protrudes outwardly from the stopping flange 22 to make the rubber opening of the rubber holding device 20 have a distance from the clamping segment 21. Accordingly, the rubber 40 can be kept from violently deforming while the rubber 40 is used to wipe writing marks out, from detaching from the clamping segment 21 or from being broken due to the violent deformation.

The cap 30 is mounted detachably on the body 10 at the holding end on which the rubber holding device 20 is mounted, is mounted around the stopping flange 22 and encloses the rubber holding device 20 completely to provide a protection effect to the rubber 40 and to prevent the rubber 40 from being dirtied.

In use, the rubber holding device 20 is drawn out from the body 10, and the stick-typed rubber 40 is inserted into the rubber holding device 20. Then, the rubber holding device 20 with the rubber 40 is inserted into the holding recess 16 in the body 10. With the abutment between the clamping protrusions 213 and the body 10, the resilient arms 212 are pressed toward each other to clamp the inner end of the rubber 40 to securely hold the rubber 40 in position. The middle portion of the rubber 40 is mounted in and abuts with the guiding segment 23, and the outer end of the rubber 40 extends out of the guiding segment 23 to serve as a wiping end. Accordingly, while wiping, the guiding segment 23 of the rubber holding device 20 can keep the rubber 40 from being violently deformed and detached from the clamping segment 21.

In addition, when the extension length of the rubber 40 is not sufficient or is broken or when the used rubber 40 has to be replaced with a new one, the rubber holding device 20 is drawn out from the holding recess 16. Then, the rubber 40 can be slid to adjust the extension length of the rubber 40, or the used rubber 40 is drawn out completely from the rubber holding device 20 to be replaced with a new one. Consequently, the rubber holding device 20 with the adjusted or new rubber 40 is inserted into the holding recess 16 for use, so that to adjust or replace the rubber 40 is easy, convenient and quick.

Figure 15:
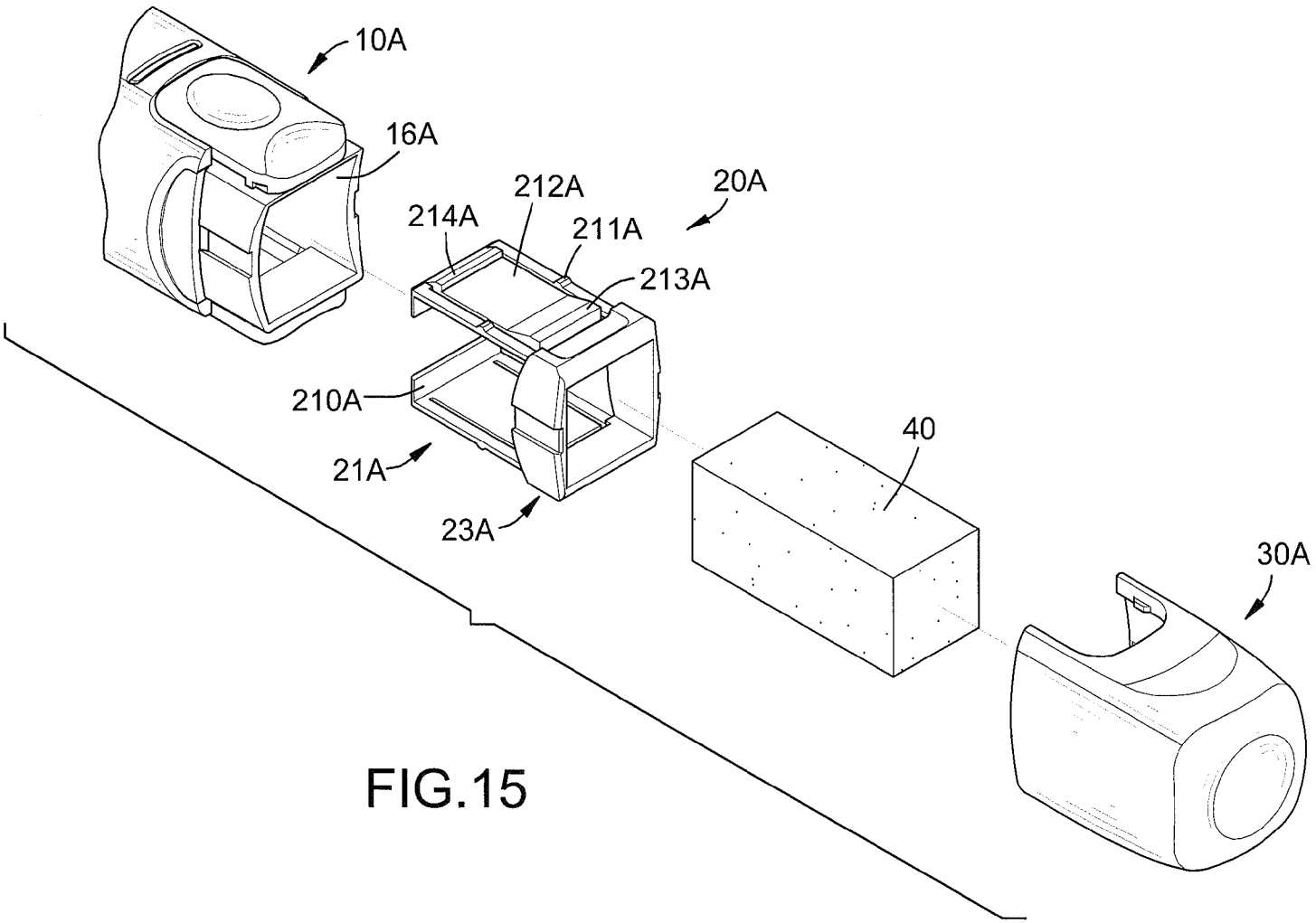
FIG. 15 is a partially exploded perspective view of a second embodiment of a rubber holding device of a thin film dispenser in accordance with the present invention.
Figure 16:
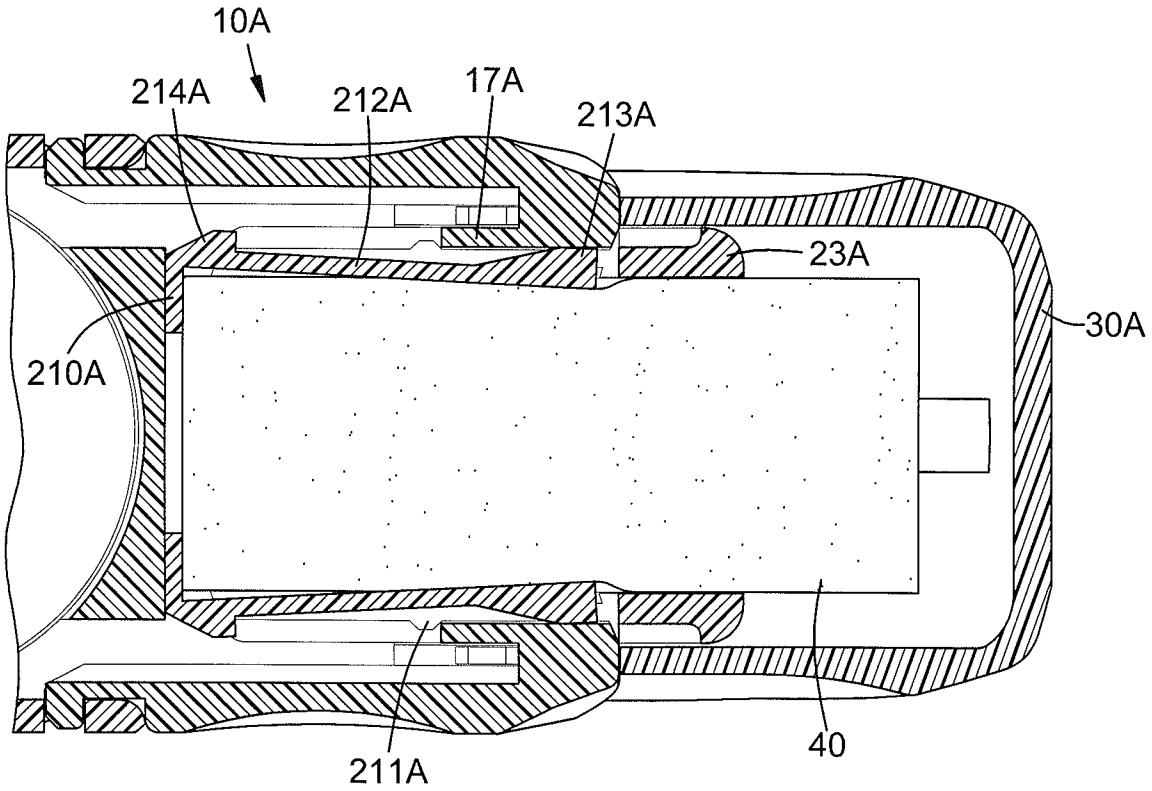
FIG. 16 is an enlarged side view in partial section of the rubber holding device in FIG. 15.
Figure 17:
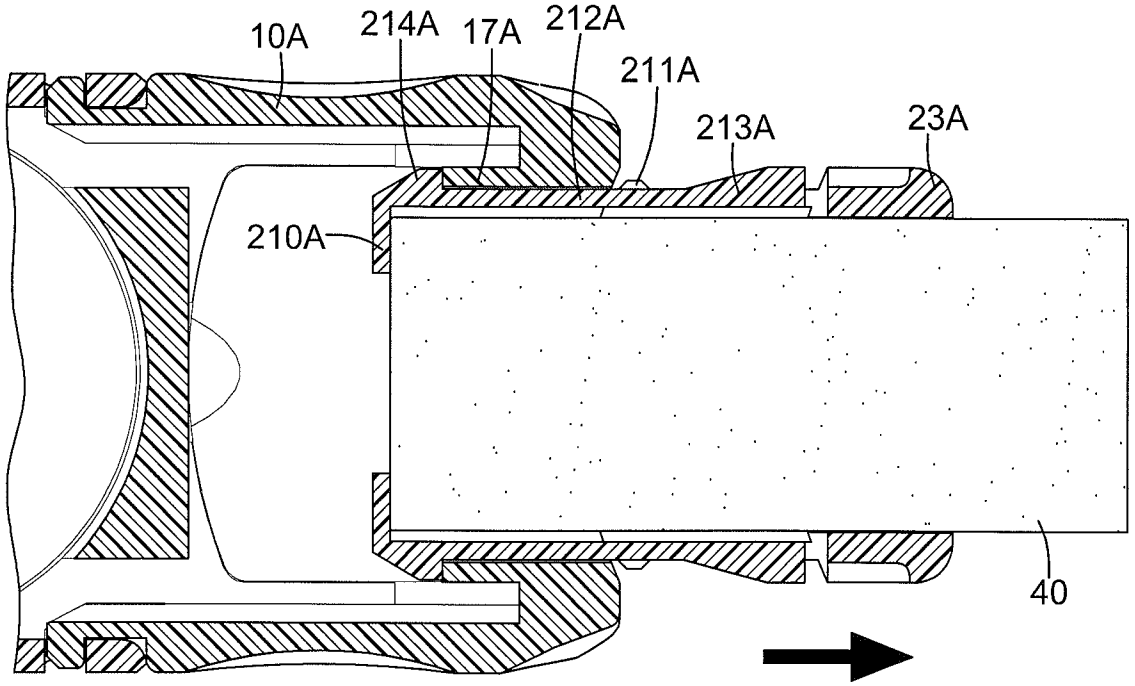
FIG. 17 is an enlarged operational side view in partial section of the rubber holding device in FIG. 15 showing a used rubber replaced with a new one.

With reference to FIGS. 15 to 17, a thin film dispenser having a second embodiment of a rubber holding device in accordance with the present invention comprises a body 10A, a rubber holding device 20A and a cap 30A.

The body 10A has a structure substantially the same as that in the first embodiment, except that the first buckling segment 17A is two buckling hooks formed respectively on two opposite sides of the inner surface of the holding recess 16A.

The rubber holding device 20A may be a hollow rectangular frame and comprises a clamping segment 21A and a guiding segment 23A. The clamping segment 21A is drawably mounted in the holding recess 16A and comprises two clamping tabs corresponding to each other. Each clamping tab has an inner end and a pressing flange 210A formed on the inner end of the clamping tab and extending toward each other to block and hold the inner end of the rubber 40. A second buckling segment 211A is formed on the middle portions of the clamping tabs and engages the first buckling segment 17A to keep the rubber holding device 20A from sliding relative to the body 10A while inserting the rubber 40 into the rubber holding device 20A. Preferably, the second buckling segment 211A comprises two buckling bosses respectively formed on and protruding from the middle portions at two sides of the clamping tabs.

Each clamping tab further has a resilient arm 212A formed on the clamping tab, and each resilient arm 212A has an inner end and an outer end. The inner end is connected integrally with the clamping tab and has a blocking protrusion 214A laterally formed on the inner end. The outer end extends outwardly and is provided with a lateral clamping protrusion 213A. The clamping protrusion 213A abuts against the inner surface of the holding recess 16A or the first buckling segment 17A to enable the resilient arm 212A to resiliently protrude into the inner space of the clamping segment 21A for securely clamping the rubber 40.

The guiding segment 23A may be a rectangular frame, is formed at the outer end of the clamping segment 21A and is mounted in and protrudes outwardly from the mouth of the holding recess 16A to make the rubber opening of the rubber holding device 20A have a distance from the clamping segment 21A. Accordingly, the rubber 40 can be kept from violently deforming while the rubber 40 is used to wipe writing marks out, from detaching from the clamping segment 21A or from being broken due to the violent deformation.

The cap 30A is mounted detachably on the body 10A at the holding end on which the rubber holding device 20A is mounted, is mounted around the guiding segment 23A and encloses the rubber holding device 20A completely to provide a protection effect to the rubber 40 and to prevent the rubber 40 from being dirtied.

The use of the second embodiment of the present invention is substantially the same as that of the first embodiment, but the operation of adjusting or replacing rubber 40 is different and described as follows.

When the extension length of the rubber 40 is not sufficient or is broken or when the used rubber 40 has to be replaced with a new one, the rubber holding device 20A is drawn out relative to the holding recess 16A until the blocking protrusions 214A on the clamping tabs engage buckling hooks of the first buckling segment 17A. Accordingly, the rubber holding device 20A can be kept from detaching from the body 10A. At this time, the first buckling segment 17A is held between the blocking protrusions 214A and the buckling bosses of the second buckling segment 211A, and the sliding movement of the rubber holding device 20A is prevented. Meanwhile, the clamping protrusions 213A on the clamping tabs escape from the body 10A and are kept from abutting with inner surfaces of the first buckling segment 17A, so the clamping protrusions 213A do not clamp onto the rubber 40. Consequently, the clamping force provided by the clamping protrusions 213A and applied to the rubber 40 is dismissed, such that the rubber 40 can be slid for adjusting the extension length of the rubber 40 or for replacing the used rubber 40 with a new one. Consequently, the rubber holding device 20A with the adjusted or new rubber 40 is pushed into the holding recess 16A, and the second buckling segment 211A is reengaged with the first buckling segment 17A. Accordingly, the operation of adjusting or replacing the rubber 40 is completed.

Figure 18:
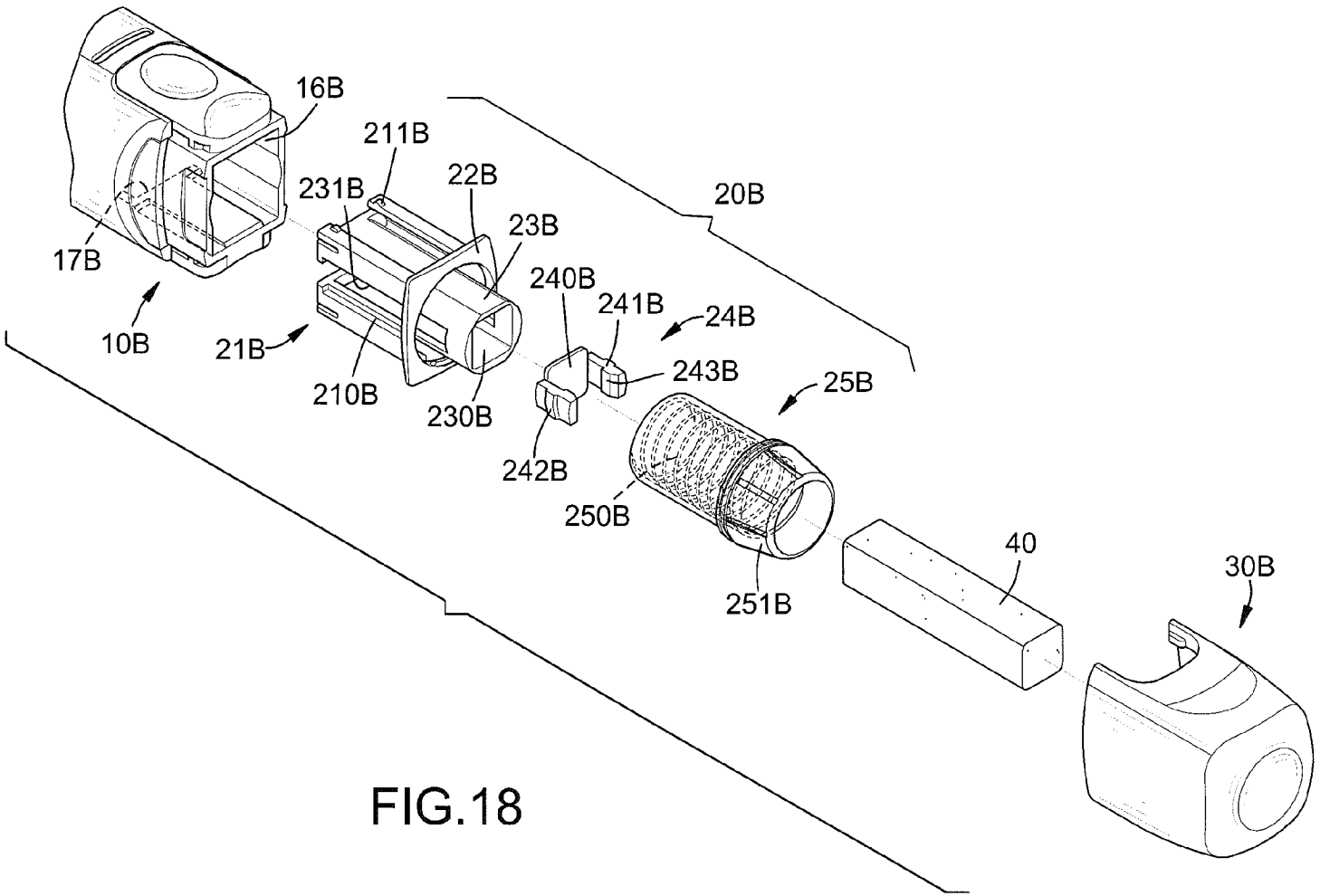
FIG. 18 is a partially exploded perspective view of a third embodiment of a rubber holding device of a thin film dispenser in accordance with the present invention.
Figure 19:
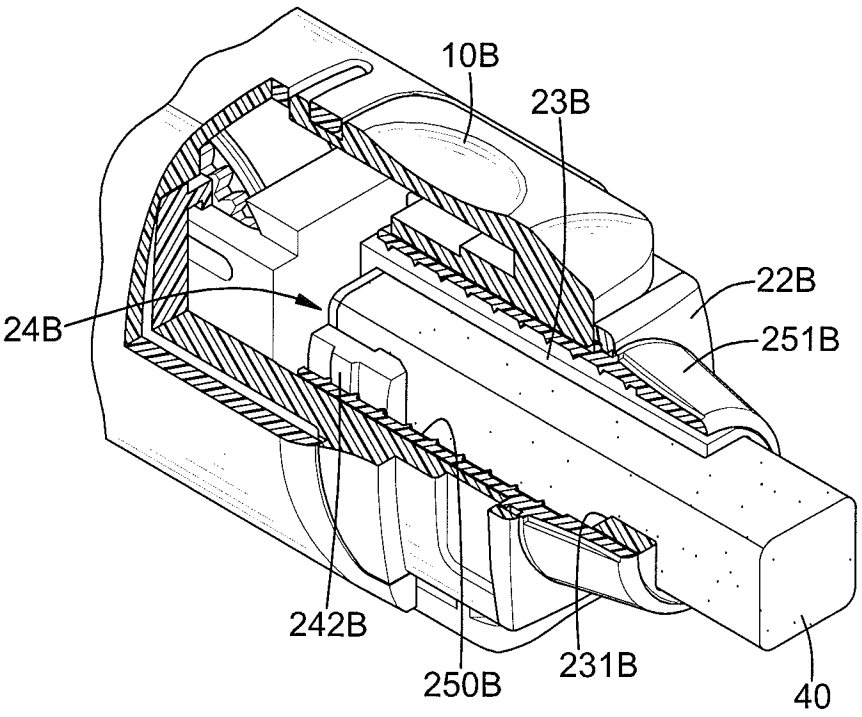
FIG. 19 is an enlarged perspective view in partial section of the rubber holding device in FIG. 18.
Figure 20:
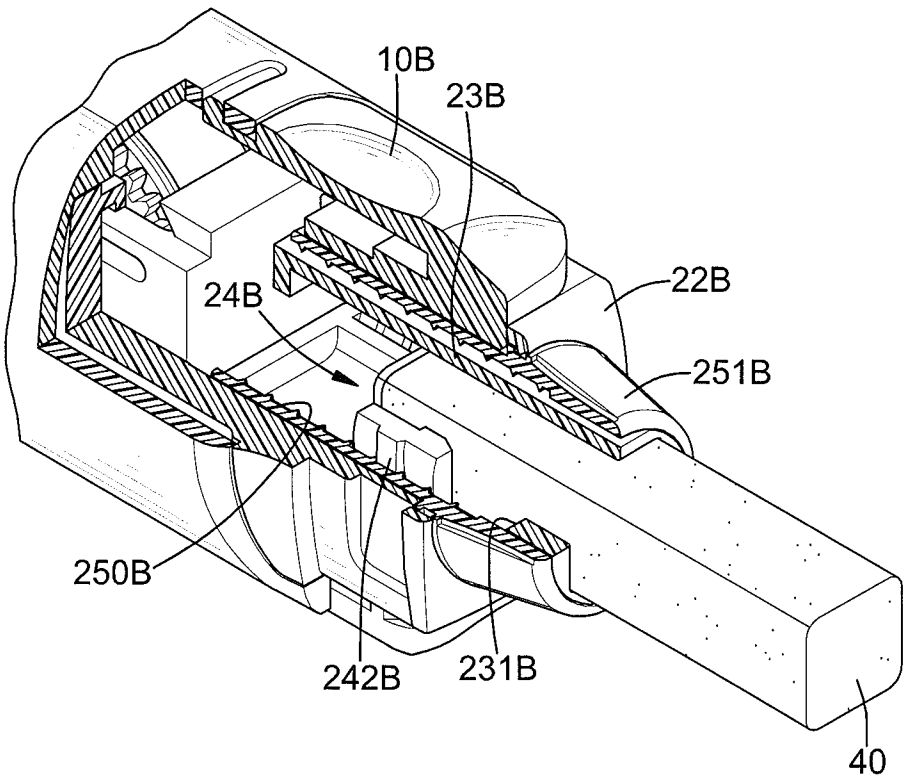
FIG. 20 is an enlarged operational perspective view in partial section of the rubber holding device in FIG. 18 showing the rubber pushed to an extended position.

With reference to FIGS. 18 to 20, a thin film dispenser having a third embodiment of a rubber holding device in accordance with the present invention comprises a body 10B, a detachable and rotatable rubber holding device 20B and a cap 30B.

The body 10B has a structure substantially the same as that in the first embodiment and further description is omitted.

The rubber holding device 20B is detachably inserted into the holding recess 16B and comprises an outer frame 21B, a stopping flange 22B, a guiding tube 23B, a pushing slider 24B and a rotating knob 25B. The outer frame 21B is mounted drawably in the holding recess 16B and has a resilient slot 210B formed laterally in a middle portion of the outer frame 21B to divide the outer frame 21B into two half frames, such that the half frames have a resilient capability to be pressed toward each other. A second buckling segment 211B is formed on the inner ends at the outer sides of the half frames and engages the first buckling segment 17B on the body 10B to keep the rubber holding device 20B from detaching from the body 10B. Preferably, the second buckling segment 211B comprises two buckling bosses respectively formed on and protruding from the inner ends at the outer sides of the half frames.

The stopping flange 22B may be rectangular, is formed around the outer frame 21B and abuts with the holding end of the body 10B at which the mouth of the holding recess 16B is defined.

The guiding tube 23B is separately mounted in the outer frame 21B to define a separate space between the outer frame 21B and the guiding tube 23B. The guiding tube 23B has an inner end integrally connected to the inner end of the outer frame 21B and an outer end extending out of the outer end of the outer frame 21B and protruding over the stopping flange 22B and out of the body 10B. The guiding tube 23B has an elongated passage 230B defined in the guiding tube 23B for holding the rubber 40 inside and having a rectangular cross section. Two guiding grooves 231B are defined longitudinally and respectively in two opposite sides of the tube wall of the guiding tube 23B. Preferably, the guiding grooves 231B correspond to and align with the resilient slot 210B in the outer frame 21B and extend from the outer end of the guiding tube 23B to a position that passes over the stopping flange 22B.

The pushing slider 24B is mounted slidably in the guiding tube 23B along the guiding grooves 231B to serve as the clamping segment of the rubber holding device 20B and comprises a pushing board 240B and two clamping wings 241B. The pushing board 240B is mounted in and corresponds to the passage 230B of the guiding tube 23B in shape and has two ends. The clamping wings 241B are formed respectively on the ends of the pushing board 240B and are mounted respectively in the guiding grooves 231B in the guiding tube 23B. Each clamping wing 241B has an inner side, an outer side, a thread rib 242B and a clamping protrusion 243B. The thread rib 242B is formed on the outer side of the clamping wing 241B. The clamping protrusion 243B is formed on the inner side of the clamping wing 241B to clamp the inner end of the rubber 40.

The rotating knob 25B may be a circular hollow tube, is mounted rotatably around the guiding tube 23B and is mounted in the outer frame 21B. The rotating knob 25B further has an inner thread 250B and a head 251B. The inner thread 250B is formed in the inner surface of the rotating knob 25B and engages the thread ribs 242B on the clamping wings 241B. The head 251B is formed on the outer end of the rotating knob 25B and abuts with the stopping flange 22B to enable the rotating knob 25B to be rotated and to drive the pushing slider 24B to move along the guiding tube 23B to adjust the extension length of the rubber 40.

The cap 30B has a structure the same as that of the first embodiment, and a detail description is omitted.

In use, the stick-typed rubber 40 is inserted into the passage 230B in the guiding tube 23B, and the inner end of the rubber 40 abuts against the pushing board 240B of the pushing slider 24B and is clamped by the clamping protrusions 243B on the clamping wings 241B. The outer end of the rubber 40 extends out of the rotating knob 25B to serve as a wiping end, and the middle portion of the rubber 40 is held and limited by the tube wall of the guiding tube 23B. Accordingly, the rubber 40 can be kept from being violently deformed and detached from the rubber holding device 20B.

When the extension length of the rubber 40 is not sufficient, when the rubber 40 is broken or when the used rubber 40 has to be replaced with a new one, the head 251B of the rotating knob 25B is rotated, and the pushing slider 24B is moved along the guiding grooves 231B in the guiding tube 23B with the engagement between the inner thread 250B and the thread ribs 242B on the clamping wings 241B. Accordingly, the rubber 40 can be pushed to extend out of the rubber opening of the rubber holding device 20B for an appropriate extension length. To replace the used rubber 40 with a new one, the head 251B is rotated until the pushing slider 24B moves to a position adjacent to the rubber opening of the rubber holding device 20B. Then, the used rubber 40 can be detached from the rubber holding device 20B, and a new rubber 40 can be inserted into the rubber holding device 20B.

When the head 251B of the rotating knob 25B is rotated in reverse, the pushing slider 24B with the rubber 40 will be moved into the guiding tube 23B along the guiding grooves 231B with the engagement between the inner thread 250B and the thread ribs 242B on the clamping wings 241B. Accordingly, the extension length of the rubber 40 can be conveniently adjusted by rotating the head 251B.

Figure 21:
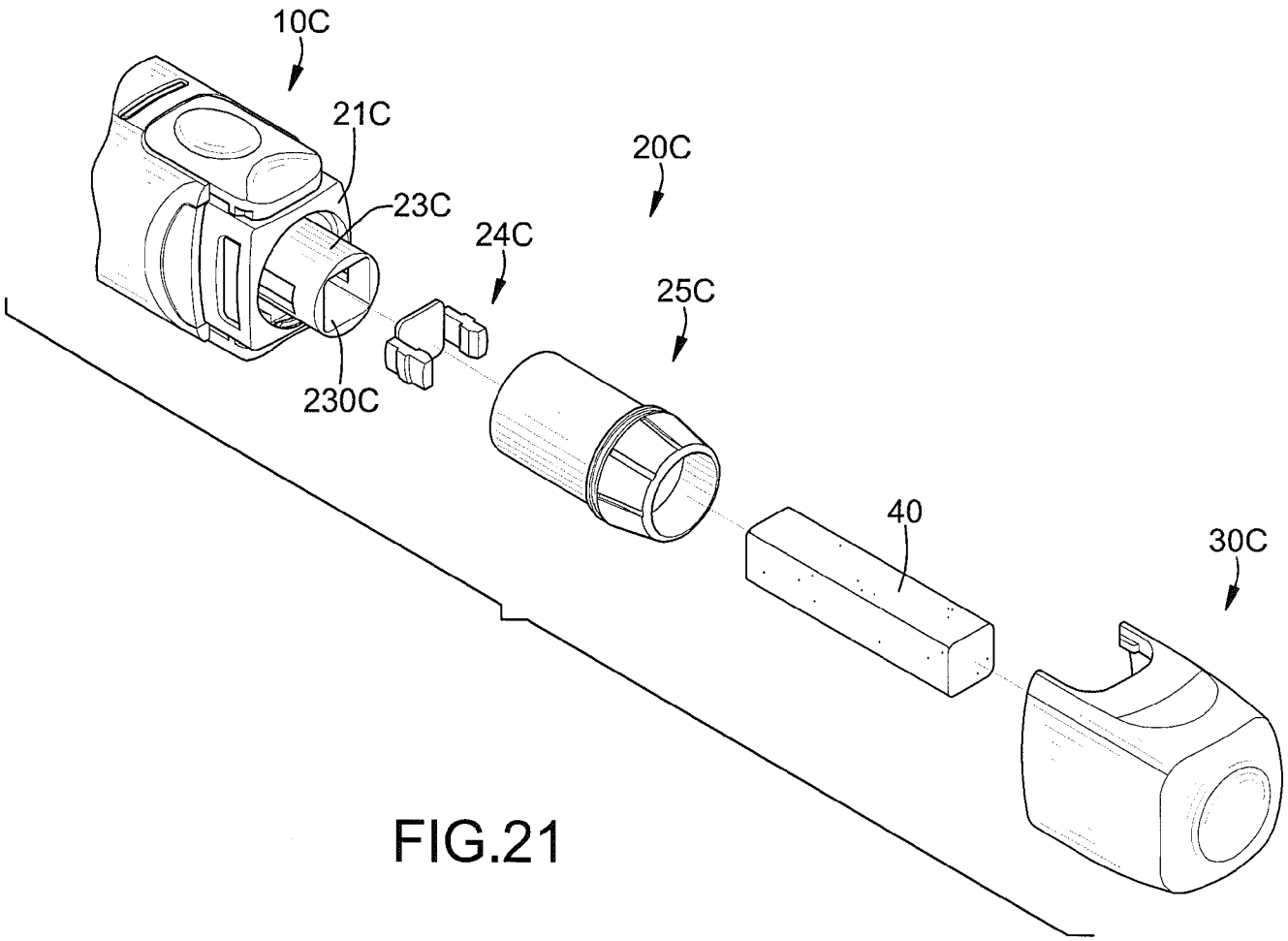
FIG. 21 is a partially exploded perspective view of a fourth embodiment of a rubber holding device of a thin film dispenser in accordance with the present invention.
Figure 22:
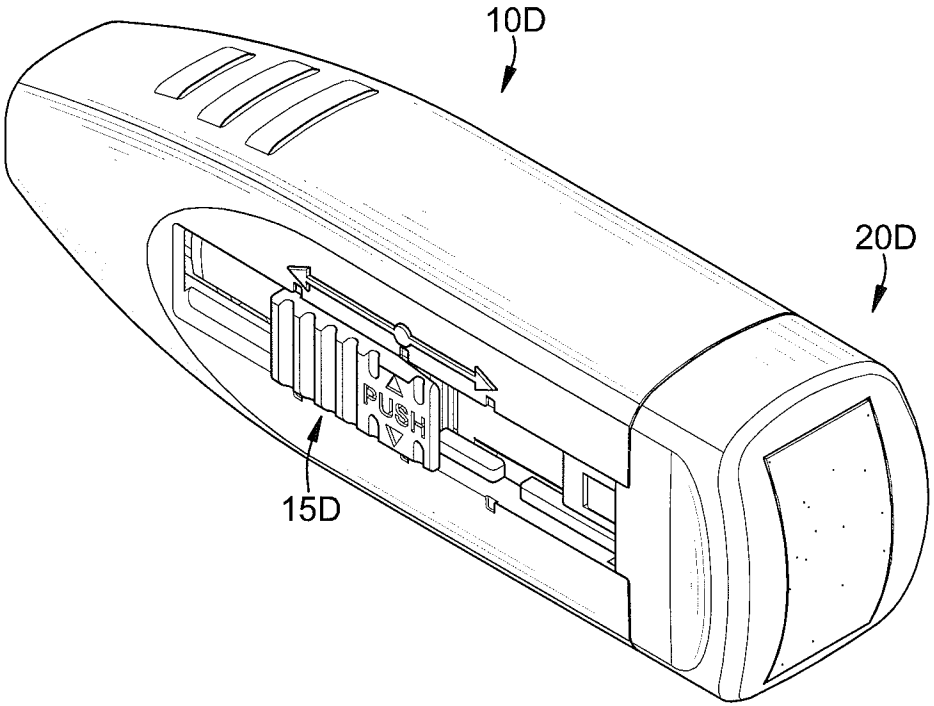
FIG. 22 is a perspective view of a third embodiment of a thin film dispenser with a fifth embodiment of a rubber holding device in accordance with the present invention.
Figures 23, 23A:
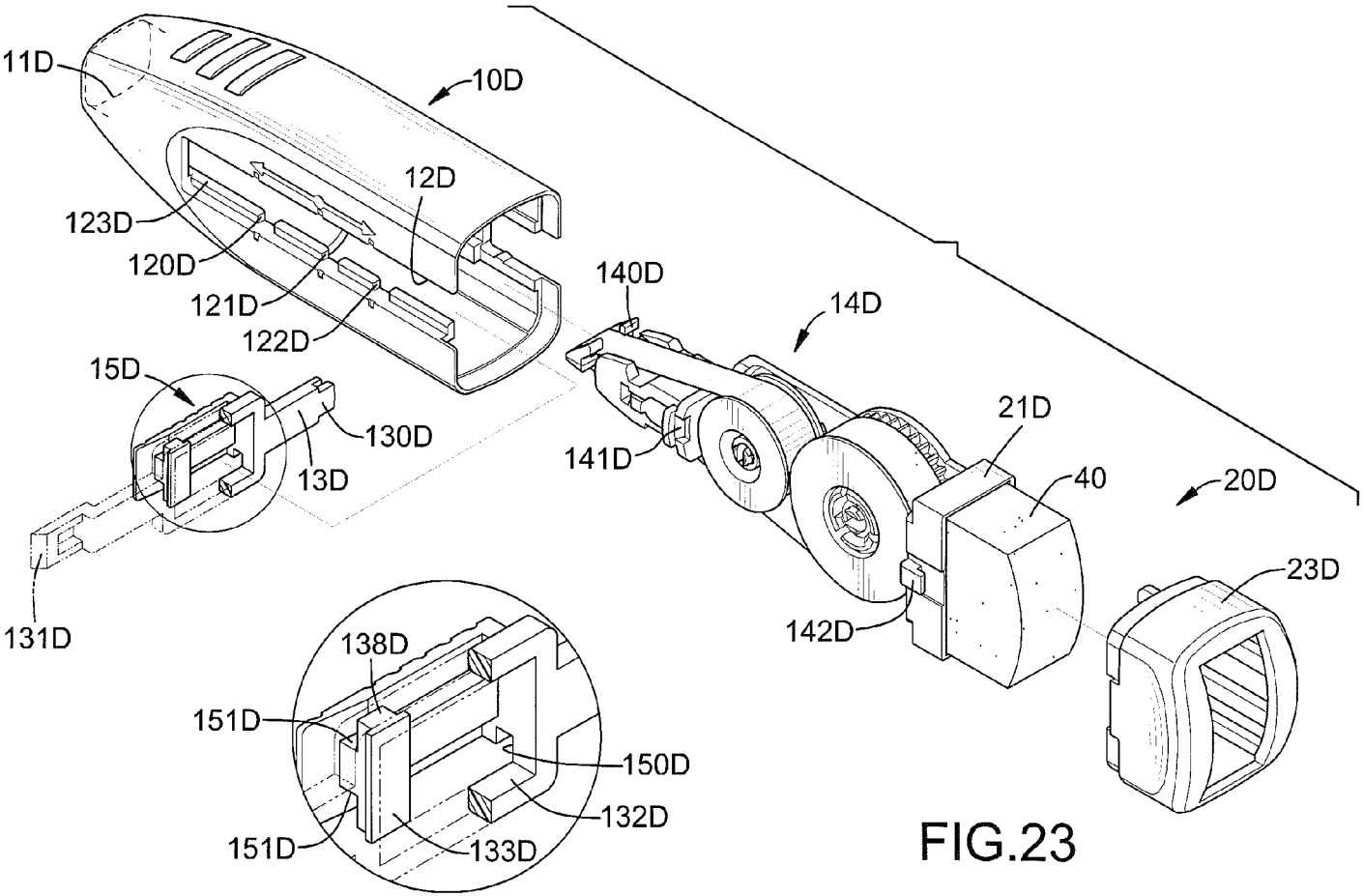
FIG. 23 is an exploded perspective view of the thin film dispenser in FIG. 22.
FIG. 23A is an enlarged perspective view of the thin film dispenser in FIG. 23.

With reference to FIG. 21, a thin film dispenser comprises an undetachable but rotatable rubber holding device 20C and has a structure substantially the same as that of the third embodiment except that the outer frame 21C and the guiding tube 23C of the rubber holding device 20C are integrally formed in the body 10C and that the stopping flange is omitted. The cap 30C is mounted detachably on the body 10C to completely enclose the rubber holding device 20C. Alternatively, the outer frame and the stopping flange can also be omitted, and the guiding tube 23C is separately mounted in the body 10C. The pushing slider 24C is moveably mounted in the passage 230C in the guiding tube 23C, and the rotating knob 25C is mounted rotatably around the guiding tube 23C and is mounted between the body 10C and the guiding tube 23C. The use and operation of the fourth embodiment are substantially the same as those of the third embodiment, and a detail description is omitted.

With reference to FIGS. 22 to 25, a third embodiment of a thin film dispenser with a fifth embodiment of a rubber holding device in accordance with the present invention comprises a dispensing unit 14D and a rubber holding device 20D combined with each other, and a moving assembly 13D, a push button 15D and a resilient positioning element 133D are integrally formed as a single part and defined as an integral pusher. The integral pusher is combined with and pushes out of or retracts the dispensing unit 14D and the rubber holding device 20D.

The body 10D may be elongated and has an opening 11D, a sliding channel 12D and multiple sets of positioning recesses. The opening 11D is defined in one end of the body 10D. The sliding channel 12D is elongated, is defined in one side of the body 10D, extends along a direction toward an end of the body 10D opposite to the opening 11D and has two side walls. The sliding channel 12D further has two guiding tracks 123D formed respectively on the side walls of the sliding channel 12D. The sets of positioning recesses may comprise three sets of positioning recesses in this embodiment, includes a first set of positioning recesses 120D, a second set of positioning recesses 121D and a third set of positioning recesses 122D, and are respectively defined in the guiding tracks 123D at intervals.

The integral pusher is mounted slidably in the sliding channel 12D and comprises the moving assembly 13D, the push button 15D and the resilient positioning element 133D formed as a single part. The moving assembly 13D is elongated, is mounted in the body 10D, corresponds to the sliding channel 12D and has a front abutting end 130D, a rear abutting end 131D and a holding hole 132D. The front abutting end 130D is adjacent to the opening 11D, and the rear abutting end 131D is opposite to the opening 11D. The holding hole 132D is defined in the moving assembly 13D between the abutting ends 130D,131D.

The push button 15D is resilient, can be deformed slightly and has a first end, two aligning recesses 151D and a second end. The first end is integrally connected with the moving assembly 13D and has two guiding notches 150D defined respectively in two sides of the first end and respectively engaging the guiding tracks 123D. The aligning recesses 151D are defined respectively in two sides of the push button 15D and selectively align respectively with the guiding notches 150D when the push button 15D is pressed. The second end extends into one side of the holding hole 132D.

The resilient positioning element 133D is integrally connected with the second end of the push button 15D and has a positioning segment 138D selectively mounted in the holding hole 132D or engage one of the sets of the positioning recesses 120D,121D,122D.

The dispensing unit 14D has a dispensing head 140D formed on a front end of the dispensing unit 14D and corresponding to the opening 11D. An engaging segment 141D is formed on the dispensing unit 14D at a side facing the integral pusher and near the front end of the dispensing unit 14D and engages the front abutting end 130D of the moving assembly 13D. A combining hook 142D is formed on the dispensing unit 14D at the side facing the integral pusher and near a rear end of the dispensing unit 14D and engages the rear abutting end 131D of the moving assembly 13D. Accordingly, the dispensing unit 14D is connected with the integral pusher.

The rubber holding device 20D is mounted on the rear end of the dispensing unit 14D and has a clamping segment 21D and a guiding segment 23D. The clamping segment 21D is integrally connected with the rear end of the dispensing unit 14D to clamp a rubber 40. The guiding segment 23D is detachably mounted around the clamping segment 21D and a rear end of the body 10D. The guiding segment 23D has an inner surface abutting with the rubber 40 to provide a guiding effect to the rubber 40. A rubber opening is defined through the guiding segment 23D to enable the rubber 40 to extend out of the rubber opening.

Figure 24:
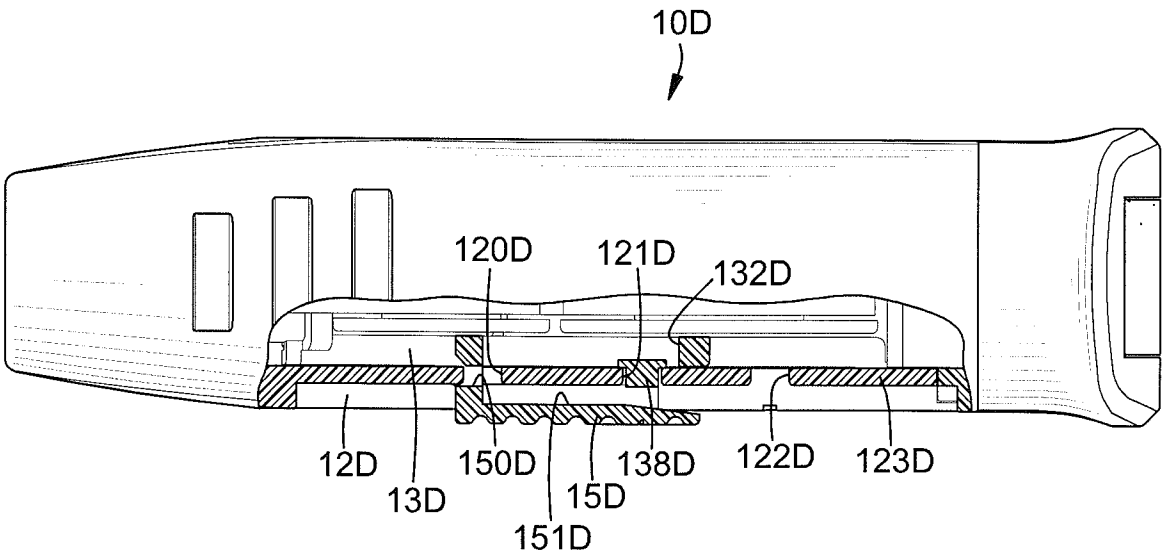
FIG. 24 is an enlarged operational top view in partial section of the thin film dispenser in FIG. 22 showing the positioning segment of the resilient positioning element engaging the second set of positioning recesses.
Figure 25:
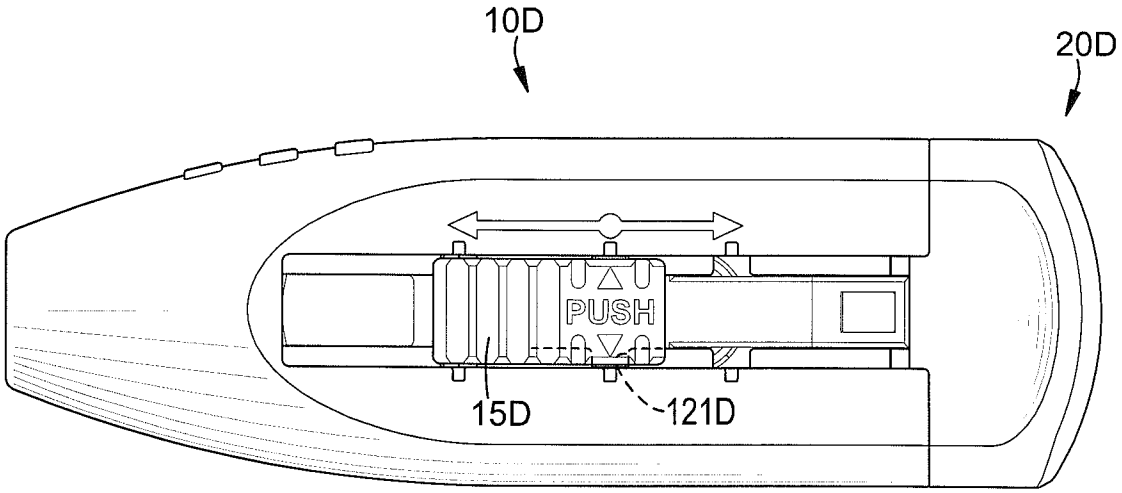
FIG. 25 is an enlarged operational side view of the thin film dispenser in FIG. 22.
Figure 26:
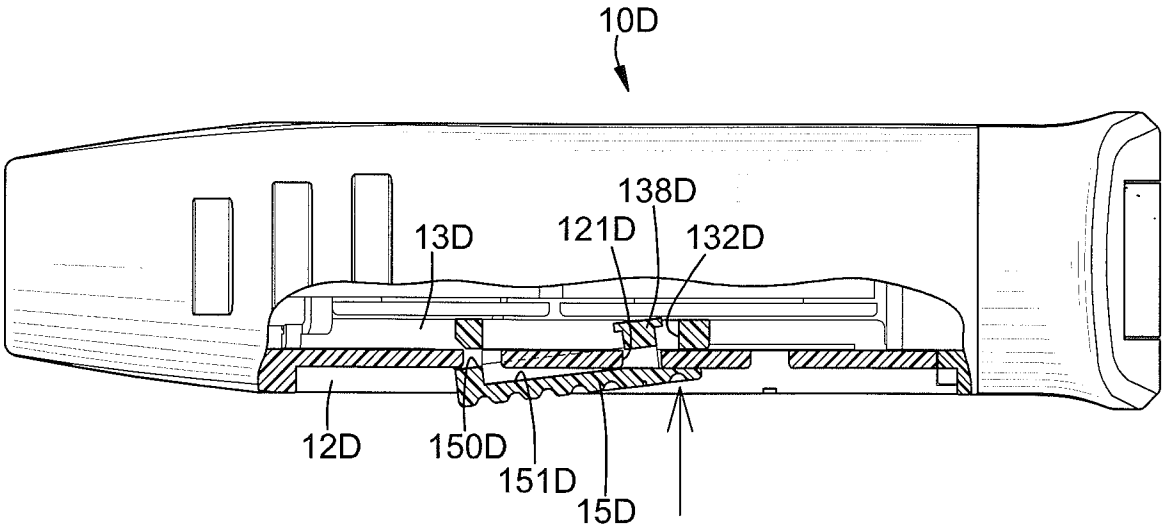
FIG. 26 is an enlarged operational top view in partial section of the thin film dispenser in FIG. 22 showing the positioning segment of the resilient positioning element pushed to disengage from the second set of positioning recesses.
Figure 27:
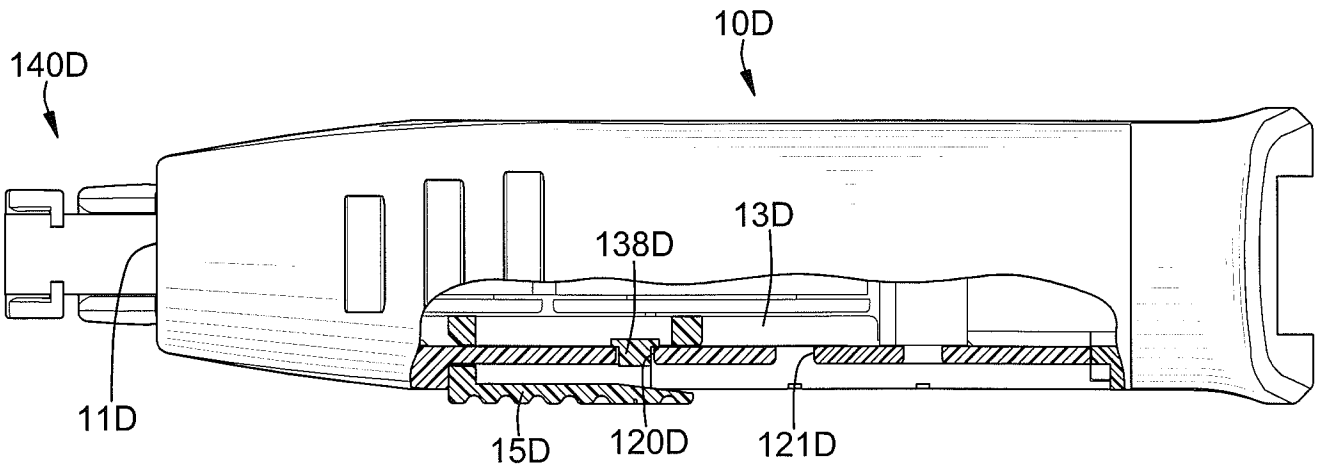
FIG. 27 is an enlarged operational top view in partial section of the thin film dispenser in FIG. 22 showing the positioning segment of the resilient positioning element engaging the first set of positioning recesses.

When the dispensing head 140D of the dispensing unit 14D is retracted in the body 10D, and with reference to FIGS. 24 and 25, the push button 15D is mounted in a middle of the sliding channel 12D. Therefore, the positioning segment 138D engages the second set of positioning recesses 121D. With reference to FIGS. 26 and 27, and when the dispensing unit 14D is in use, the push button 15D is pressed to disengage the positioning segment 138D from the second set of positioning recesses 121D and to hold the positioning segment 138D in the holding hole 132D. At this time, the push button 15D is inclined to align the aligning recesses 151D respectively with the guiding notches 150D. Accordingly, the aligning recesses 151D respectively engage the guiding tracks 123D to enable the push button 15D to move along the sliding channel 12D toward the first set of positioning recesses 120D. Consequently, the moving assembly 13D and the dispensing unit 14D are moved with the push button 15D to extend the dispensing head 140D out of the opening 11D. When the positioning segment 138D is moved to a position corresponding to the first set of positioning recesses 120D, the positioning segment 138D will engage the first set of positioning recesses 120D with the resilience of the push button 15D. Thus, the dispensing head 140D of the dispensing unit 14D is held at the expanded position. To retract the dispensing head 140D into the body 10D, the push button 15D is pressed to disengage the positioning segment 138D from the first set of positioning recess 120D. Then, the push button 15D is moved backward along the sliding channel 12D to engage the positioning segment 138D with the second set of positioning recess 121D.

Figure 28:
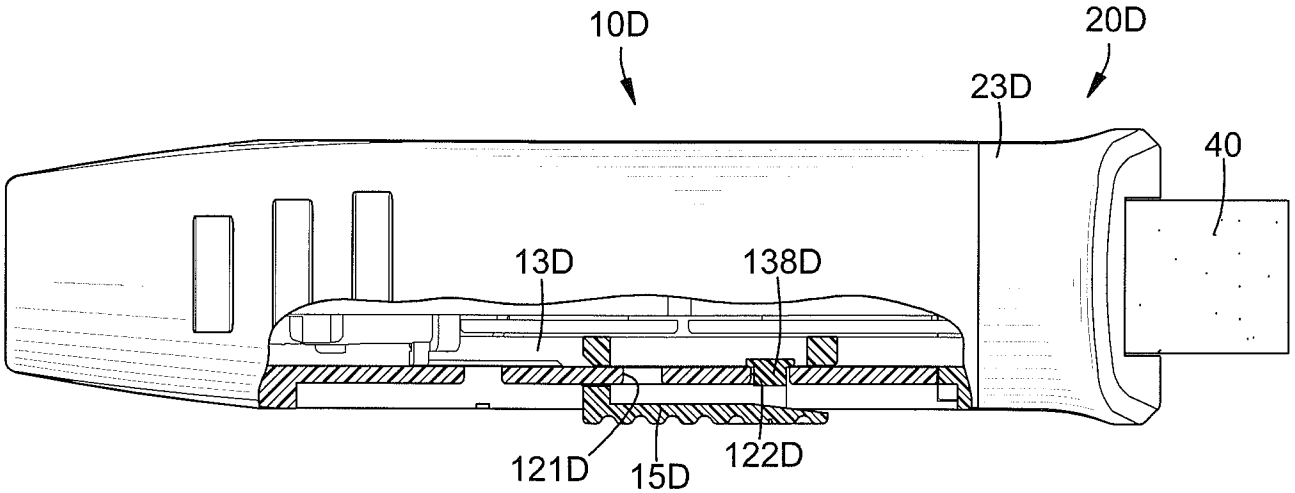
FIG. 28 is an enlarged operational top view in partial section of the thin film dispenser in FIG. 22 showing the positioning segment of the resilient positioning element engaging the third set of positioning recesses.
Figure 29:
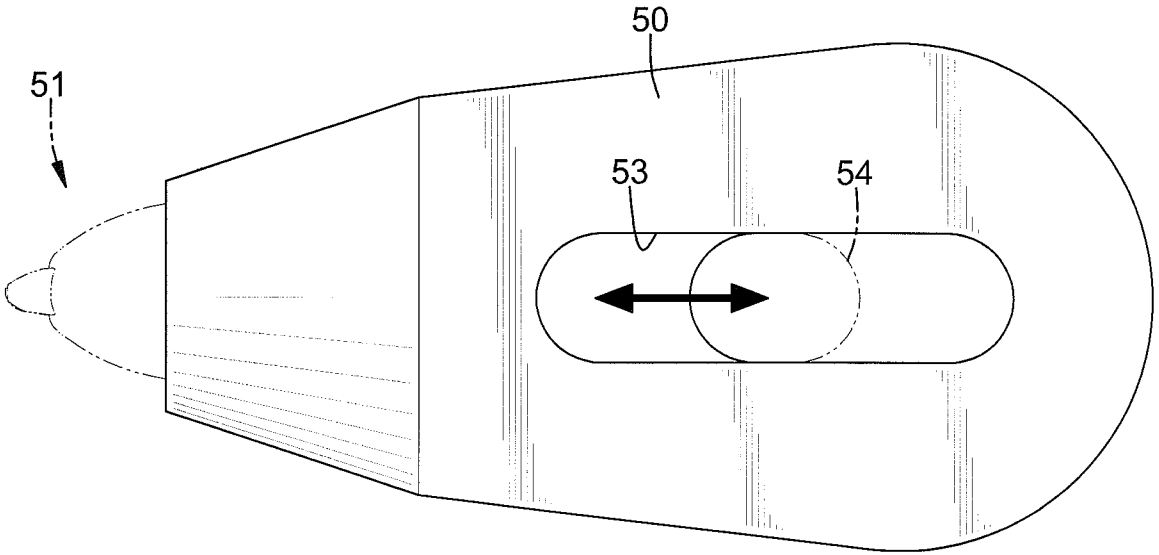
FIG.29 PRIOR ART
FIG. 29 is a top view of a conventional correction tape of the '109 patent.
Figure 30:
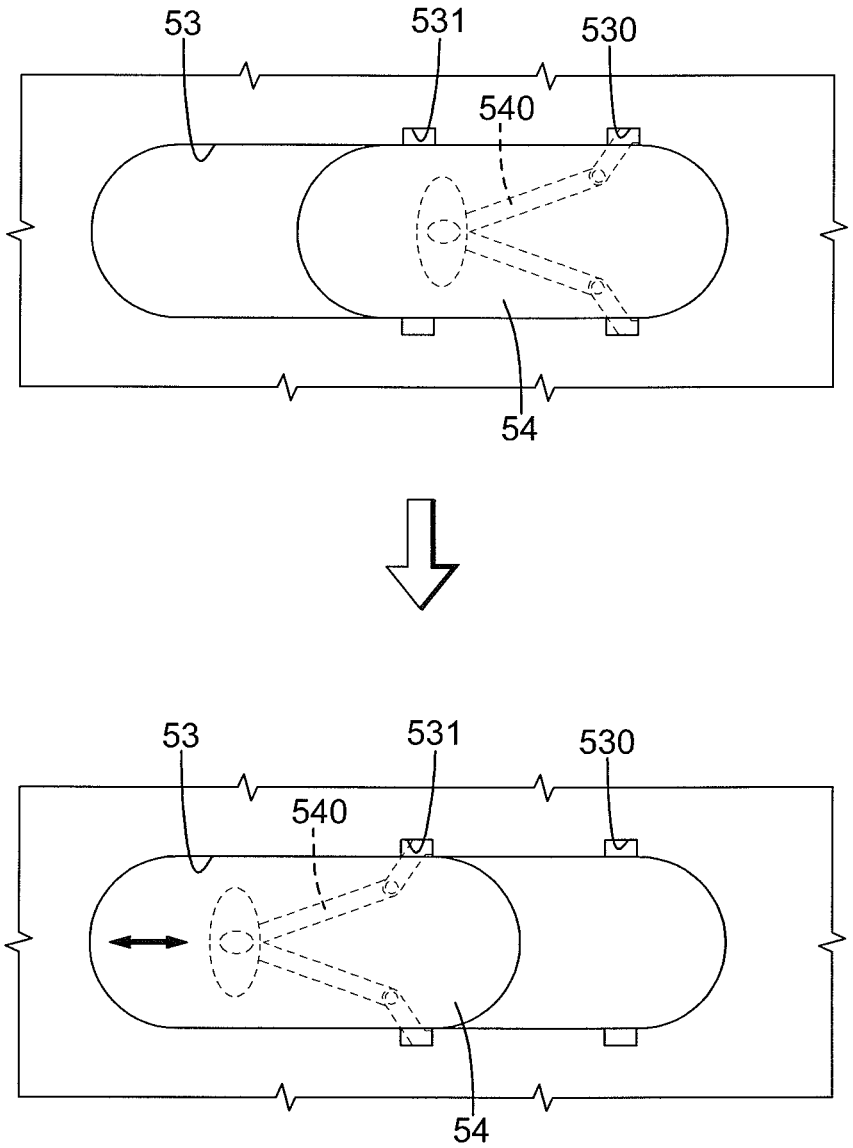
FIG.30 PRIOR ART
FIG. 30 shows operational top views of the conventional correction tape in FIG. 29.
Figure 31:
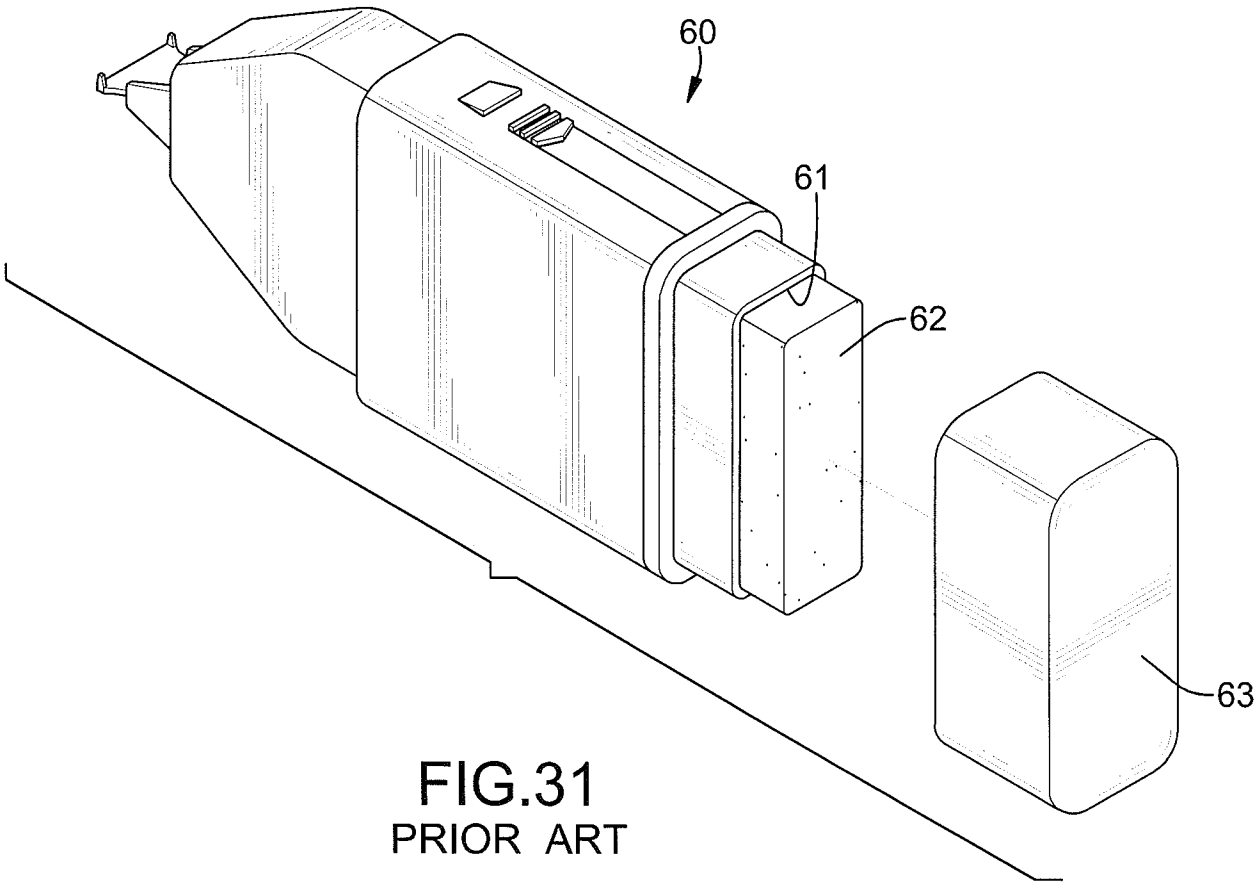
FIG.31 PRIOR ART
FIG. 31 is an exploded perspective view of a conventional correction tape of the '995 patent.

When the rubber 40 is in use, with reference to FIGS. 26 and 28, the push button 15D is pressed to disengage the positioning segment 138D from the second set of positioning recesses 121D, and the push button 15D is moved along the sliding channel 12D toward the third set of positioning recesses 122D. Consequently, the moving assembly 13D and the dispensing unit 14D are moved with the push button 15D to extend the rubber 40 out of the rubber opening in the guiding segment 23D. When the positioning segment 138D is moved to a position corresponding to the third set of positioning recesses 122D, the positioning segment 138D will engage the third set of positioning recesses 122D with the resilience of the push button 15D. Thus, the rubber 40 is held at the expanded position. The operation of retracting the rubber 40 into the body 10D is substantially the same, and its description is omitted. In addition, if more sets of positioning recesses are formed between the third set of positioning recesses 122D and the rear end of the body 10D, the rubber 40 can be held at different extension lengths relative to the body 10D. Accordingly, the extension length of the rubber 40 can be adjusted.

With the above description, the rubber holding device 20 in accordance with the present invention has capabilities of adjusting an extension length of the rubber 40 relative to the body 10 and conveniently replacing the rubber 40. The rubber 40 can be pushed to extend out of the body 10 for use and can be retracted completely after wiping, so the use of the rubber 40 is convenient and versatile. As to replacement, the rubber 40 can be easily replaced by drawing the rubber holding device 20 out from the body 10 or rotating the rotating knob 25, and this is convenient in operation.

In addition, because the rubber holding device 20 has a clamping segment 21 and a guiding segment 23, the rubber 40 can be securely clamped by the clamping segment 21 to prevent the rubber 40 from detaching from the body 10. The guiding segment 23 can keep the rubber 40 from being violently deformed during wiping and has capabilities of preventing the rubber 40 from detaching from the body 10 and of absorbing the deformation of the rubber 40.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A thin film dispenser comprising:

a body having:

an opening defined in one end of the body;

a sliding channel defined in one side of the body, extending along a direction and having two side walls; and multiple sets of positioning recesses defined respectively and separately in the two side walls of the sliding channel;

a moving assembly mounted in the body; and a resilient positioning element connected to the moving assembly and comprising:

a positioning segment extending along a direction perpendicular to that of the sliding channel and selectively engaging one of the multiple sets of positioning recesses;

a dispensing unit mounted in the body, connected to the moving assembly and having a dispensing head corresponding to the opening of the body; and a push button mounted slidably in the sliding channel of the body, connected to the moving assembly and selectively pushing against the positioning segment of the resilient positioning element to disengage from a corresponding set of positioning recesses to enable the moving assembly to move relative to the body, wherein:

the moving assembly has a first frame and a second frame formed on the moving assembly at a side facing the sliding channel, mounted in the sliding channel and located respectively at two sides of the positioning segment of the resilient positioning element;

the first frame has a first abutting flange formed on the first frame;

the second frame has a second abutting flange formed on the second frame; and the push button further has:

a first pushing block formed on an inner surface of the push button, held slidably in the first frame and selectively abutting with the first abutting flange; and a second pushing block formed on the inner surface of the push button, held slidably in the second frame and selectively abutting with the second abutting flange.

2. The thin film dispenser as claimed in claim 1, wherein:

the first frame has two first frame panels parallel with each other;

the second frame has two second frame panels parallel with each other;

the first pushing block is mounted between the two first frame panels; and the second pushing block is mounted between the two second frame panels.

3. The thin film dispenser as claimed in claim 2, wherein the body comprises:

a front housing having:

a first end in which the opening of the body is defined;

a second end formed as a combining mouth; and a side provided with an assembling hole; and a rear housing having:

a first end mounted in the combining mouth in the second end of the front housing; and a side corresponding to the side of the front housing in which the assembling hole is defined, wherein the sliding channel and the multiple sets of positioning recesses are defined in the side of the rear housing.

4. The thin film dispenser as claimed in claim 3, wherein:

the front housing further has a supporting segment formed adjacent to the assembling hole; and the rear housing further has a combining segment supported on the supporting segment of the front housing.

5. The thin film dispenser as claimed in claim 4, wherein the moving assembly further has a dispensing unit mounting post formed on a side of the moving assembly opposite to the sliding channel.

6. The thin film dispenser as claimed in claim 3, wherein the moving assembly further has a dispensing unit mounting post formed on a side of the moving assembly opposite to the sliding channel.

7. The thin film dispenser as claimed in claim 2, wherein the moving assembly further has a dispensing unit mounting post formed on a side of the moving assembly opposite to the sliding channel.

8. The thin film dispenser as claimed in claim 2, wherein:

the first pushing block has an inclined surface defined in a side facing the second pushing block; and the second pushing block has an inclined surface defined in a side facing the first pushing block to define a receiving recess between the first and second pushing blocks and to hold the positioning segment of the resilient positioning element inside.

9. The thin film dispenser as claimed in claim 8, wherein the moving assembly further has a dispensing unit mounting post formed on a side of the moving assembly opposite to the sliding channel.

10. The thin film dispenser as claimed in claim 1, wherein:

the first pushing block has an inclined surface defined in a side facing the second pushing block; and the second pushing block has an inclined surface defined in a side facing the first pushing block to define a receiving recess between the first and second pushing blocks and to hold the positioning segment of the resilient positioning element inside.

11. The thin film dispenser as claimed in claim 10, wherein the moving assembly further has a dispensing unit mounting post formed on a side of the moving assembly opposite to the sliding channel.

12. The thin film dispenser as claimed in claim 1, wherein the moving assembly further has a dispensing unit mounting post formed on a side of the moving assembly opposite to the sliding channel.

13. A thin film dispenser comprising:

a body having:

an opening defined in one end of the body;

a sliding channel defined in one side of the body, extending along a direction and having two side walls;

multiple sets of positioning recesses defined respectively and separately in the two side walls of the sliding channel; and a holding recess defined in a holding end of the body opposite to the opening, wherein the holding recess in the body has an inner surface and a first buckling segment formed on the inner surface of the holding recess;

a moving assembly mounted in the body;

a resilient positioning element connected to the moving assembly and comprising:

a positioning segment extending along a direction perpendicular to that of the sliding channel and selectively engaging one of the multiple sets of positioning recesses;

a dispensing unit mounted in the body, connected to the moving assembly and having a dispensing head corresponding to the opening of the body; and a push button mounted slidably in the sliding channel of the body, connected to the moving assembly and selectively pushing against the positioning segment of the resilient positioning element to disengage from a corresponding set of positioning recesses to enable the moving assembly to move relative to the body; and a rubber holding device mounted in the holding recess of the body and comprising:

a rubber opening defined in the rubber holding device at a position relative to the holding end of the body;

a clamping segment slidably mounted in the holding recess of the body, being slidable between the holding recess and the rubber opening of the rubber holding device to adjust the extension length of a rubber relative to the body and comprising multiple clamping protrusions for pressing against the rubber; and a guiding segment connected to the clamping segment and extending out of the holding recess in the body to make the opening of the rubber holding device have a distance from the clamping segment to guide and buffer a deformation of the rubber while a force is applied to the rubber, wherein:

the rubber holding device further has an outer frame mounted around the guiding tube and having an inner end and an outer end; and the outer frame has a second buckling segment formed on the inner end of the outer frame and engaging the first buckling segment.

14. The thin film dispenser as claimed in claim 13, wherein:
the rubber holding device further comprises:
a guiding tube having:
an elongated passage for holding the rubber inside; and
two guiding grooves formed respectively and longitudinally in two opposite sides of the tube wall of the guiding tube;
a pushing slider mounted slidably in the guiding tube along the two guiding grooves to serve as the clamping segment of the rubber holding device, with two clamping protrusions formed respectively on two ends of the pushing slider; and
a rotating knob mounted rotatably around the guiding tube and connected to and driving the pushing slider to move;
the pushing slider further has two thread ribs formed respectively on the ends of the pushing slider and respectively mounted in the two guiding grooves in the guiding tube; and
the rotating knob further has:
an inner thread formed in an inner surface of the rotating knob and engaging the two thread ribs on the pushing slider; and
a head formed on an outer end of the rotating knob to enable the rotating knob to be rotated and to drive the pushing slider to move along the guiding tube to adjust the extension length of the rubber.

15. The thin film dispenser as claimed in claim 14, wherein:
the pushing slider comprises:
a pushing board mounted in the passage of the guiding tube and having two ends; and
two clamping wings formed respectively on the ends of the pushing board and mounted respectively in the two guiding grooves in the guiding tube, with each clamping wing having an inner side and an outer side;
the clamping protrusions are formed respectively on the inner sides of the two clamping wings of the pushing slider; and
the two thread ribs are formed respectively on the outer sides of the two clamping wings of the pushing slider.

16. The thin film dispenser as claimed in claim 15, wherein:
the rubber holding device further has an outer frame mounted around the guiding tube and having an inner end and an outer end;
the guiding tube is separately mounted in the outer frame and has:
an inner end connected to the inner end of the outer frame; and
an outer end extending out of the outer end of the outer frame; and
the rotating knob is mounted between the guiding tube and the outer frame.

17. The thin film dispenser as claimed in claim 16, wherein:
the holding recess in the body has an inner surface and a first buckling segment formed on the inner surface of the holding recess; and
the outer frame has a second buckling segment formed on the inner end of the outer frame and engaging the first buckling segment.

18. The thin film dispenser as claimed in claim 17, wherein:
the first buckling segment comprises two buckling cavities formed respectively in two opposite sides of the inner surface of the holding recess; and
the second buckling segment comprises two buckling bosses respectively formed on and protruding from two opposite outer sides of the outer frame and engaging respectively the buckling cavities.

19. The thin film dispenser as claimed in claim 18, wherein the outer frame has a resilient slot formed laterally in a middle portion of the outer frame to divide the outer frame into two half frames.

20. The thin film dispenser as claimed in claim 19, wherein the outer end of the outer frame is further provided with a stopping flange abutting on a mouth of the holding recess.

21. The thin film dispenser as claimed in claim 20, wherein the outer end of the guiding tube extending out of the stopping flange on the outer frame to abut the head of the rotating knob on the stopping flange of the outer frame.

22. The thin film dispenser as claimed in claim 21, wherein the two guiding grooves correspond to the resilient slot in the outer frame and extend from the inner end of the guiding tube to a position that passes over the stopping flange.

23. The thin film dispenser as claimed in claim 16 further comprising a cap mounted around the rubber holding device.

24. The thin film dispenser as claimed in claim 16, wherein the outer frame has a resilient slot formed laterally in a middle portion of the outer frame to divide the outer frame into two half frames.

25. The thin film dispenser as claimed in claim 24, wherein the outer end of the outer frame is further provided with a stopping flange abutting on a mouth of the holding recess.

26. The thin film dispenser as claimed in claim 24, wherein the two guiding grooves correspond to the resilient slot in the outer frame and extend from the inner end of the guiding tube to a position that passes over the stopping flange.

27. The thin film dispenser as claimed in claim 14, wherein:
the guiding tube is separately mounted in the outer frame and has:
an inner end connected to the inner end of the outer frame; and
an outer end extending out of the outer end of the outer frame; and
the rotating knob is mounted between the guiding tube and the outer frame.

28. The thin film dispenser as claimed in claim 27, wherein:
the first buckling segment comprises two buckling cavities formed respectively in two opposite sides of the inner surface of the holding recess; and
the second buckling segment comprises two buckling bosses respectively formed on and protruding from two opposite outer sides of the outer frame and engaging respectively the buckling cavities.

29. The thin film dispenser as claimed in claim 28, wherein the outer frame has a resilient slot formed laterally in a middle portion of the outer frame to divide the outer frame into two half frames.

30. The thin film dispenser as claimed in claim 29, wherein the outer end of the outer frame is further provided with a stopping flange abutting on a mouth of the holding recess.

31. The thin film dispenser as claimed in claim 30, wherein the outer end of the guiding tube extending out of the stopping flange on the outer frame to abut the head of the rotating knob on the stopping flange of the outer frame.

32. The thin film dispenser as claimed in claim 31, wherein the two guiding grooves correspond to the resilient slot in the outer frame and extend from the inner end of the guiding tube to a position that passes over the stopping flange.

33. The thin film dispenser as claimed in claim 27 further comprising a cap mounted around the rubber holding device.

34. The thin film dispenser as claimed in claim 27, wherein the outer frame has a resilient slot formed laterally in a middle portion of the outer frame to divide the outer frame into two half frames.

35. The thin film dispenser as claimed in claim 34, wherein the outer end of the outer frame is further provided with a stopping flange abutting on a mouth of the holding recess.

36. The thin film dispenser as claimed in claim 34, wherein the two guiding grooves correspond to the resilient slot in the outer frame and extend from the inner end of the guiding tube to a position that passes over the stopping flange.

* * * * *